US007333096B2

(12) United States Patent
Washio et al.

(10) Patent No.: US 7,333,096 B2
(45) Date of Patent: Feb. 19, 2008

(54) DISPLAY DEVICE AND DRIVING METHOD THEREOF

(75) Inventors: Hajime Washio, Sakurai (JP); Yasuyoshi Kaise, Tenri (JP); Sachio Tsujino, Yao (JP); Kazuhiro Maeda, Nara (JP); Keiji Takahashi, Tenri (JP); Yasushi Kubota, Sakurai (JP); Toshiya Aoki, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 364 days.

(21) Appl. No.: 10/316,193

(22) Filed: Dec. 11, 2002

(65) Prior Publication Data

US 2003/0122773 A1 Jul. 3, 2003

(30) Foreign Application Priority Data

Dec. 18, 2001 (JP) ..... 2001-384105
Nov. 5, 2002 (JP) ..... 2002-321628

(51) Int. Cl.
*G09G 5/00* (2006.01)
*G09G 3/36* (2006.01)

(52) U.S. Cl. ..... 345/204; 345/103

(58) Field of Classification Search ..... 345/100, 345/103, 212, 213, 204
See application file for complete search history.

(56) References Cited

U.S. PATENT DOCUMENTS 5,136,282 A * 8/1992 Inaba et al. ..... 345/97
5,432,525 A * 7/1995 Maruo et al. ..... 345/2.2
5,881,299 A * 3/1999 Nomura et al. ..... 713/324
6,246,385 B1 * 6/2001 Kinoshita et al. ..... 345/87
6,246,399 B1 6/2001 Yamane et al.

(Continued)

FOREIGN PATENT DOCUMENTS

CN 1163444 A 10/1997

(Continued)

OTHER PUBLICATIONS

Chinese Office Action and English translation thereof mailed Oct. 1, 2004 in corresponding Chinese patent application No. 02157446.4.

*Primary Examiner*—Sumati Lefkowitz
*Assistant Examiner*—Rodney Amadiz
(74) *Attorney, Agent, or Firm*—Nixon & Vanderhye PC

(57) ABSTRACT

A control signal generating circuit CTL for controlling the writing into pixels PIX instructs a data signal line drive circuit SD2, which is for driving pixels in a non-display area, to write a voltage VB or a voltage VW which are for non-displaying, not only in the first frame but also once in a predetermined number of frames. In other words, the pixels in the display area is refreshed at intervals longer than those in the case of refreshing the pixels in each frame. Thus, even if the mobility of an active element is high and the leak current on the occasion of OFF-state is large, or even if a large amount of electric charge is accumulated because of the photoelectric effect due to the use of a backlight, it is possible to prevent unnecessary displaying on the display area, which is caused because the writing into the pixels in the display area influences on the pixels in the non-display area, and hence it is possible to improve the quality of partial displaying, while restraining the power consumption.

14 Claims, 20 Drawing Sheets

U.S. PATENT DOCUMENTS 6,384,807 B1 * 5/2002 Furuhashi et al. ..... 345/96
6,522,319 B1 * 2/2003 Yamazaki ..... 345/103
6,624,800 B2 * 9/2003 Hughes et al. ..... 345/88
2001/0017611 A1 * 8/2001 Moriyama ..... 345/100
2001/0033278 A1 10/2001 Ohta et al.
2002/0196241 A1 * 12/2002 Morita ..... 345/204

FOREIGN PATENT DOCUMENTS

JP 5-188885 7/1993
JP 11-184434 7/1999

* cited by examiner

DISPLAY DEVICE AND DRIVING METHOD THEREOF

FIELD OF THE INVENTION

The present invention relates to a display device using active elements such as TFTs and a driving method thereof, and particularly relates to a display device which is capable of carrying out so-called partial drive, i.e. displaying an image only in a portion of a display area.

BACKGROUND OF THE INVENTION

With recent strong demands of the reduction in power consumption of image display devices, the foregoing partial drive, which is to display an image with significance only in a portion of the display area, has been carried out such as a standby-image on the screen of mobile phones. In this partial drive, a data signal line drive circuit is stopped on the occasion of the scanning of a non-display area on which no displaying is carried out, so that the reduction of power consumption is realized.

However, in the case of image display devices such as a passive matrix driving type, a simple matrix driving type, etc., it is necessary to write a voltage thereto in order to maintain the displaying, so that the data signal line drive circuit is stopped with respect to each scanning of the non-display area. In contrast, in image display devices such as a TFT active matrix type adopting the foregoing active elements, on the occasion of the partial drive, electric charges of the previous frame at the time of displaying on the entire screen are remained in pixels. To resolve this, Japanese Laid-Open Patent Application No. 11-184434/1999 (Tokukaihei 11-184434; published on Jul. 9, 1999) discloses a driving method in which an OFF voltage for non-displaying is applied to the pixels in the non-display area in the first frame period, and no voltage is applied to these pixels in the frame periods after the first frame period. In other words, in this driving method, the data signal line drive circuit is stopped except during the first frame. With this arrangement, this invention aims at reducing the frequency of charging a data signal line whose capacity is larger than that of a pixel capacitor, and reducing the power consumption.

Incidentally, there have recently been strong demands for higher resolution and displaying of moving images, and hence the mobility of the foregoing active elements is getting higher, in order to speedily write electric charges into the pixels. However, the higher the mobility of the active elements becomes, the more a leak current on the occasion of OFF-state increases. For this reason, in the foregoing arrangement of the conventional art, an unnecessary image which seems like a line defect is generated in the non-display area, since a voltage written into the pixels in the display area influences on the pixels of non-display area.

SUMMARY OF THE INVENTION

The objective of the present invention is to provide (i) a display device which exhibits lower power consumption and better quality of displaying, on the occasion of carrying out displaying with a plurality of modes, e.g. displaying and non-displaying, on a display section using an active element, and (ii) a driving method thereof.

To achieve the foregoing objective, the driving method of the display device in accordance with the present invention, the display device being provided with a display section which is composed of a plurality of pixels each including an active element, comprises the steps of: setting at least two refresh rates of the pixels; dividing the display section into a plurality of areas; and writing data into the pixels in the plurality of areas at any one of the at least two refresh rates.

In this driving method, data is written into the pixels in the plurality of areas constituting the display section, at any one of not less than two refresh rates. For instance, when displaying a flashing colon (:) for briefly counting seconds in a clock on the screen, an area including the image of the clock is produced by means of the division of the display section and only the flashing portion of the area is rewritten, so that the area is rewritten in each second, i.e. at a refresh rate of 1 Hz, and areas other than this area are rewritten at 60 Hz like a television picture. Moreover, the refresh rates of respective display areas are arranged so as to be different from each other. For instance, when a static image is displayed in an area other than the foregoing area, the refresh rate of this area is set to be 15 Hz.

As described above, if the pixels permit to freely arrange the length of refresh periods, it is possible to divide the display section into a plurality of areas according to transfer rates of the data and refresh rates, so as to arrange various refresh rates of displaying. In other words, unnecessary refreshing is eliminated and each area has a different refresh rate, i.e. frame rates are arranged so as to be different from each other, so that the power consumption can be reduced.

As a result, it is possible to provide a driving method of a display device which exhibits lower power consumption and better quality of displaying, on the occasion of carrying out displaying with a plurality of modes such as displaying and non-displaying on a display section using an active element.

Further, to achieve the foregoing objective, the display device in accordance with the present invention is an active matrix display device comprising a control signal generating circuit for controlling writing of data into pixels of a display section, by driving a data signal line drive circuit and a scanning line drive circuit, wherein: the writing of the data into the pixels can be controlled by not less than two refresh rates; the display section is divided into a plurality of areas; and the data is written into the pixels in the plurality of areas at the not less than two refresh rates.

In this display device, the data is written into the pixels in the plurality of areas constituting the display section, at any one of not less than two refresh rates. On this account, it is possible to provide a display device which exhibits lower power consumption and better quality of displaying, on the occasion of carrying out displaying with a plurality of modes such as displaying and non-displaying on a display section using an active element.

For a fuller understanding of the nature and advantages of the invention, reference should be made to the ensuing detailed description taken in conjunction with the accompanying drawings.

DESCRIPTION OF THE EMBODIMENTS

First Embodiment

Referring to the figures, the following description will discuss an embodiment in accordance with the present invention.

Figure 1:
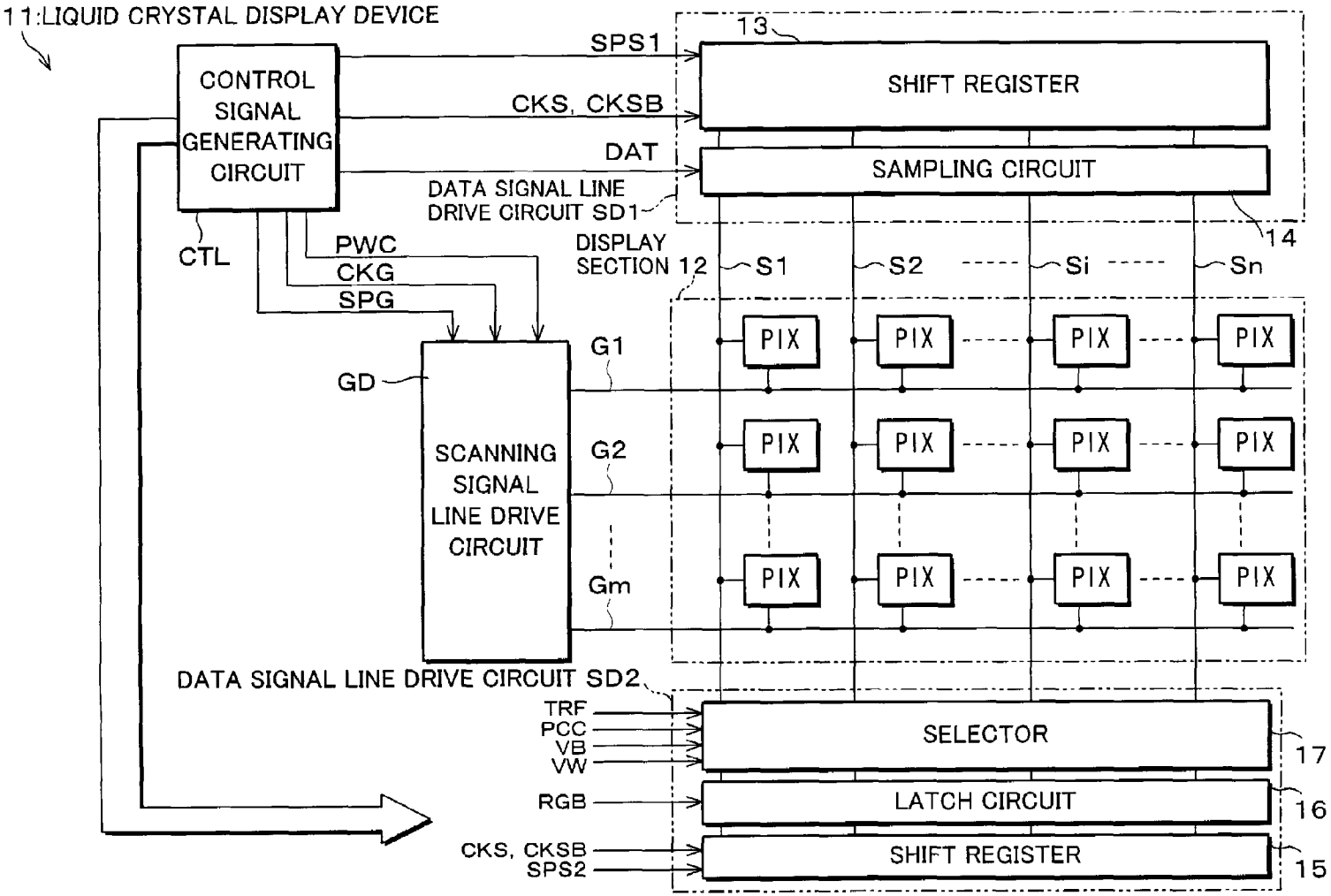
FIG. 1 is a block diagram, illustrating an electrical arrangement of a liquid crystal display device which is a display device in accordance with an embodiment of the present invention.

FIG. 1 illustrates an embodiment of a display device in accordance with the present invention, and is a block diagram illustrating an electrical arrangement of a liquid crystal display device 11. This liquid crystal display device 11 is a TFT active matrix liquid crystal display device, and roughly includes: a display section 12; a scanning signal line drive circuit GD; a data signal line drive circuit SD1; a data signal line drive circuit SD2; and a control signal generating circuit CTL.

Figure 2:
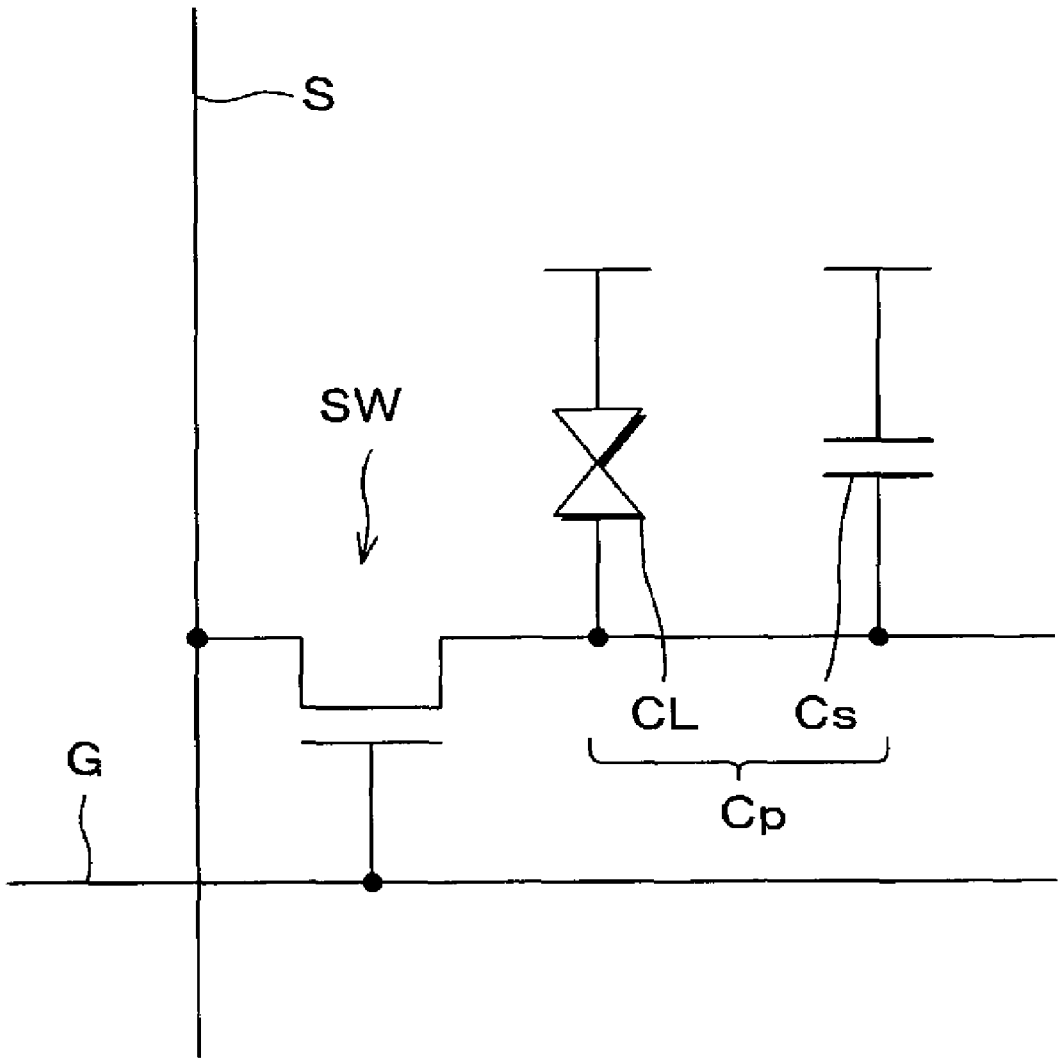
FIG. 2 is an equivalent circuit diagram of each pixel of the liquid crystal display device of FIG. 1.

The display section 12 is provided with: a plurality of scanning signal lines G1, G2, . . . , Gm (collectively termed G); data signal lines S1, S2, . . . , Sn (collectively termed S) intersecting with the scanning signal lines G; and pixels PIX provided in respective areas sectioned by the scanning signal lines G and the data signal lines S in a matrix manner. Each of the pixels PIX includes, as FIG. 2 illustrates, an active element SW composed of the aforementioned TFT and a pixel capacitor Cp. When the scanning signal lines G are selected so as to be scanned, the active element SW captures either an image signal DAT or electric potentials VB and VW (described later), both supplied via the data signal lines S, into the pixel capacitor Cp. The image signal DAT or the electric potentials VB and VW is(are) stored in the pixel capacitor Cp even during a non-selection period, so that the pixel capacitor Cp continues the displaying. The pixel capacitor Cp is composed of a liquid crystal capacitor CL and an auxiliary capacitor Cs.

Figure 3:
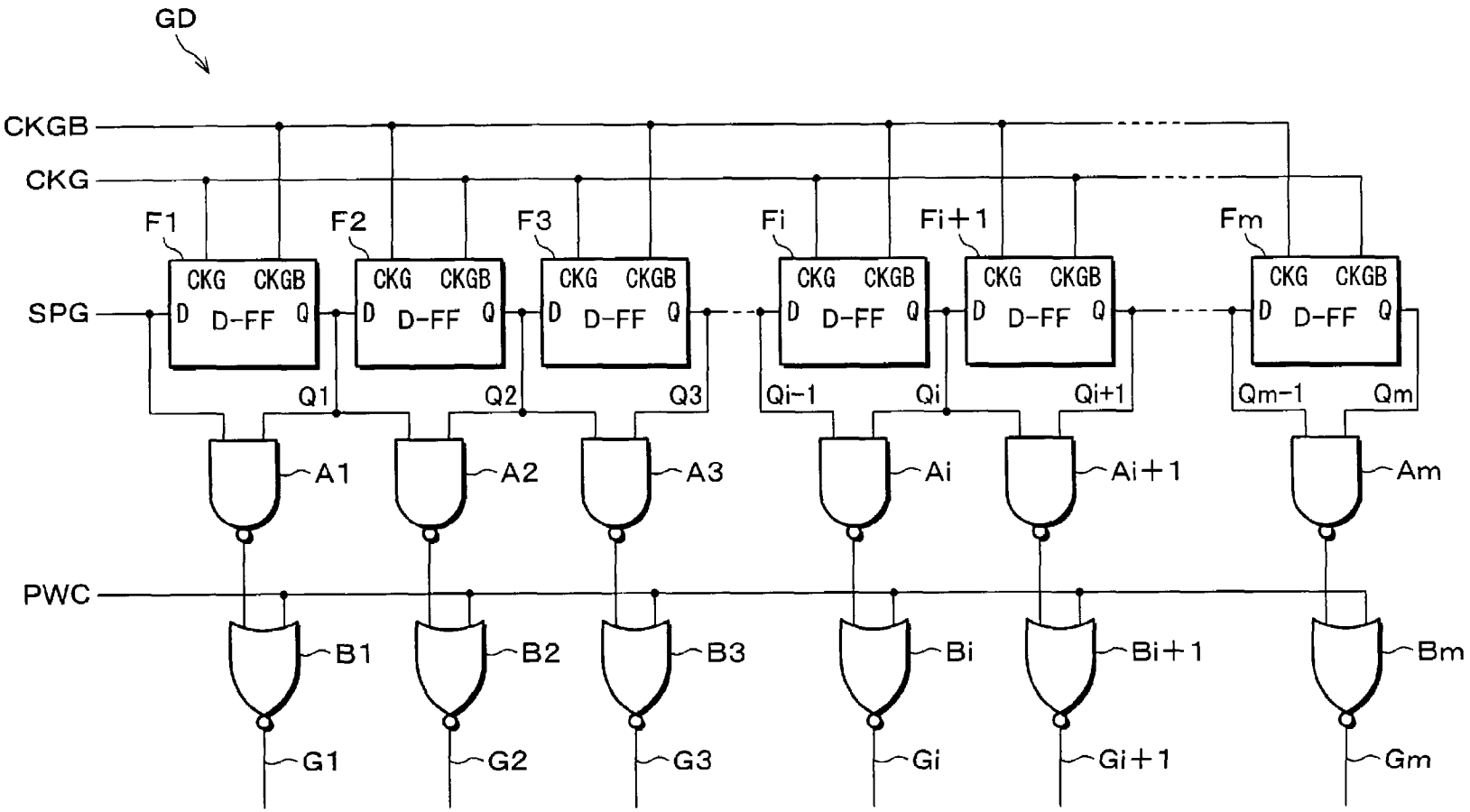
FIG. 3 is a block diagram, illustrating an arrangement of a scanning signal line drive circuit of the liquid crystal display device of FIG. 1.

FIG. 3 is a block diagram, illustrating an arrangement of the scanning signal line drive circuit GD. This scanning signal line drive circuit GD is provided with: m-stage shift registers F1-Fm corresponding to the respective scanning signal lines G1-Gm; NAND gates A1-Am; and NOR gates B1-Bm. The shift registers F1-Fm progressively output pulses of the scanning start signal SPG, in sync with timing signals such as a clock signal CKG supplied from the control signal generating circuit CTL, an inversion signal CKGB which is inversion of the clock signal CKG, and the scanning start signal SPG. The NAND gates A1-Am perform NAND operations on the inputs and the outputs of the corresponding shift registers F1-Fm, and output the results to respective inputs of the corresponding NOR gates B1-Bm. To the other inputs of the respective NOR gates B1-Bm, a pulse width control signal PWC is commonly supplied from the control signal generating circuit CTL. With this arrangement, the NOR gates B1-Bm can perform NOR operations on the pulse width control signal PWC and the outputs from the respective NAND gates A1-Am.

Figure 4:
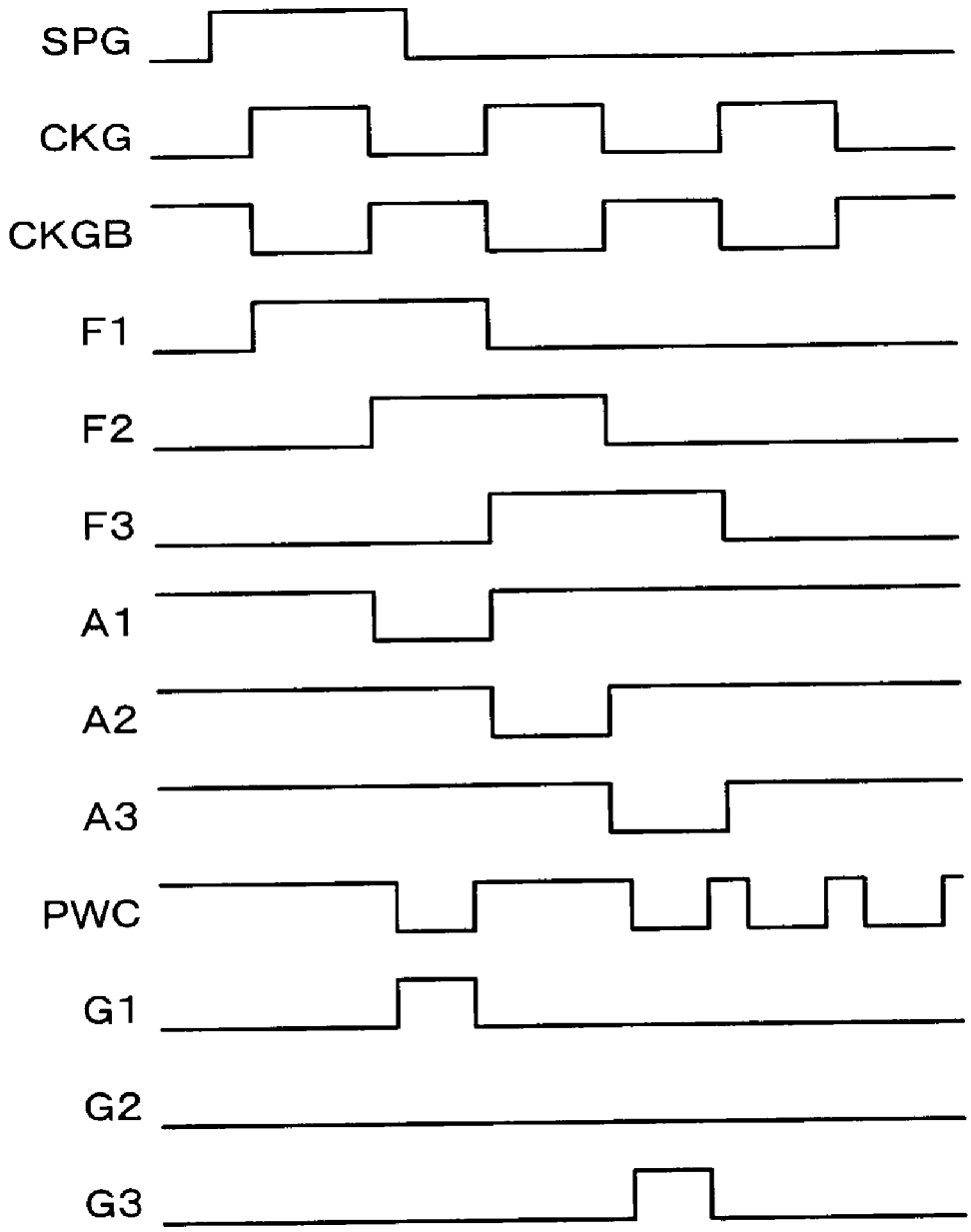
FIG. 4 illustrates waveform charts of respective parts of the scanning signal line drive circuit of the liquid crystal display device of FIG. 1.

Thus, among the scanning signal lines G1-Gm, only the scanning signal lines in which the pulse width control signal PWC is active progressively receive a selection pulse corresponding to the pulse width of the pulse width control signal PWC. FIG. 4 illustrates output waveforms of respective parts of the scanning signal line drive circuit GD, on occasions when the pulse width control signal PWC is active in scanning signal lines G1 and G3, and is inactive in a scanning signal line G2.

FIG. 3 describes that the scanning signal line drive circuit GD is provided with: m-stage shift registers F1-Fm corresponding to the scanning signal lines G1-Gm; the NAND gates A1-Am; and the NOR gates B1-Bm. However, the present invention is not limited to this arrangement. Provided that the NOR gates B1-Bm are first logic circuits and the NAND gates A1-Am are second logic circuits, the second logic circuits are not always necessary to be provided so that the pulses from the m-stage shift registers may be directly supplied to the first logic circuits. Moreover, the first logic circuits are not necessarily NOR gates, and the second logic circuits are not necessarily NAND gates.

The data signal line drive circuit SD1 is composed of a shift register 13 and a sampling circuit 14. In sync with timing signals such as a clock signal CKS supplied from the control signal generating circuit CTL, an inversion signal CKSB which is inversion of the clock signal CKS, and a data scanning start signal SPS1, tho shift register 13 causes an image signal DAT supplied to an analog switch of the sampling circuit 14 to be sampled. The sampled image signal DAT is written into the data signal lines S as occasion demands.

While the data signal line drive circuit SD1 writes a multiple gray-scale image DAT into the data signal line S, the data signal line drive circuit SD2 writes binary data which is either the electric potential VB or the electric potential VW. These electric potentials VB and VW are selected in accordance with the electric potential of an opposed electrode, so as to become non-display data in the non-display area on the occasion of the partial drive (described later).

The data signal line drive circuit SD2 roughly includes: a shift register 15; a latch circuit 16; and a selector 17. Similar to the shift register 13 of the data signal line drive circuit SD1, the shift register 15 is composed of flip flops which are connected in a cascade manner. In the shift register 15, when clock signals CKS and CKSB and a data scanning start signal SPS2 are supplied from the control signal generating circuit CTL, the data scanning start signal SPS2 is outputted between the neighboring flip flops, so as to become a latch pulse. In response to this latch pulse, the latch circuit 16 successively latches binary image signals RGB supplied from the control signal generating circuit CTL. Also, in response to a control signal TRF supplied from the control signal generating circuit CTL, the selector 17 selects either one of liquid crystal applied voltages VB and VW, which are supplied from a non-illustrated power source, in accordance with the image signals RGB, so as to output the selected voltage to the data signal lines S.

Here, analog data which is supplied from the outside is generally supplied via an external analog amplifier, and the power consumption of this analog amplifier is considerably large. Thus, the reduction of the power consumption can be achieved when the binary analog data outputted from the data signal line drive circuit SD2 is generated by selecting the liquid crystal applied voltages VB and VW, which are supplied from the power source, using the image signals RGB, rather than the binary analog data is directly supplied from the outside via the analog amplifier.

By the way, in the arrangement illustrated in FIG. 1, the data signal line drive circuit SD1 is connected to one end of each of the data signal lines S, while the data signal line drive circuit SD2 is connected to the other end of each of the data signal lines S. However, the identical effects can be obtained when these circuits are provided on the same side of the display section 12.

Figure 5:
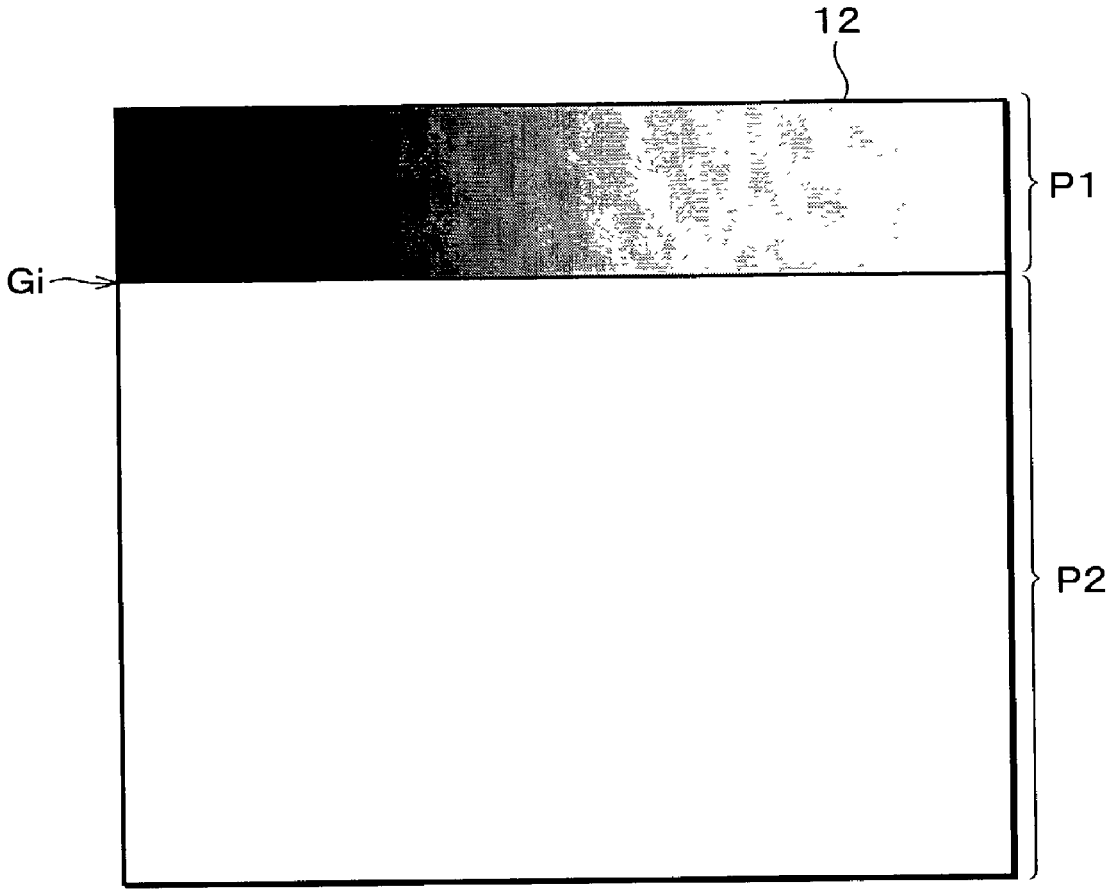
FIG. 5 illustrates an example of the displaying on the occasion of partial drive of the liquid crystal display device of FIG. 1.

FIG. 5 illustrates an example of the displaying on the occasion of the partial drive of the aforementioned liquid crystal display device 11. In the display section 12 of this example, setting an arbitrary scanning signal line Gi as a demarcation line, there are a partial display area P1 from the scanning signal line G1 to the scanning signal line Gi−1 and a non-display area P2 from the scanning signal line Gi to the scanning signal line Gm. In this example, the partial display area P1 is driven by the data signal line drive circuit SD1 so that multi-scale displaying is carried out thereon, while the non-display area P2 is driven by the data signal line drive circuit SD2 so that blank displaying, i.e. displaying black color or white color (lighting or non-lighting) is carried out thereon. Incidentally, provided that the partial display area P1 carries out binary displaying, the area P1 may be driven by the data signal line drive circuit SD2.

Figure 6:
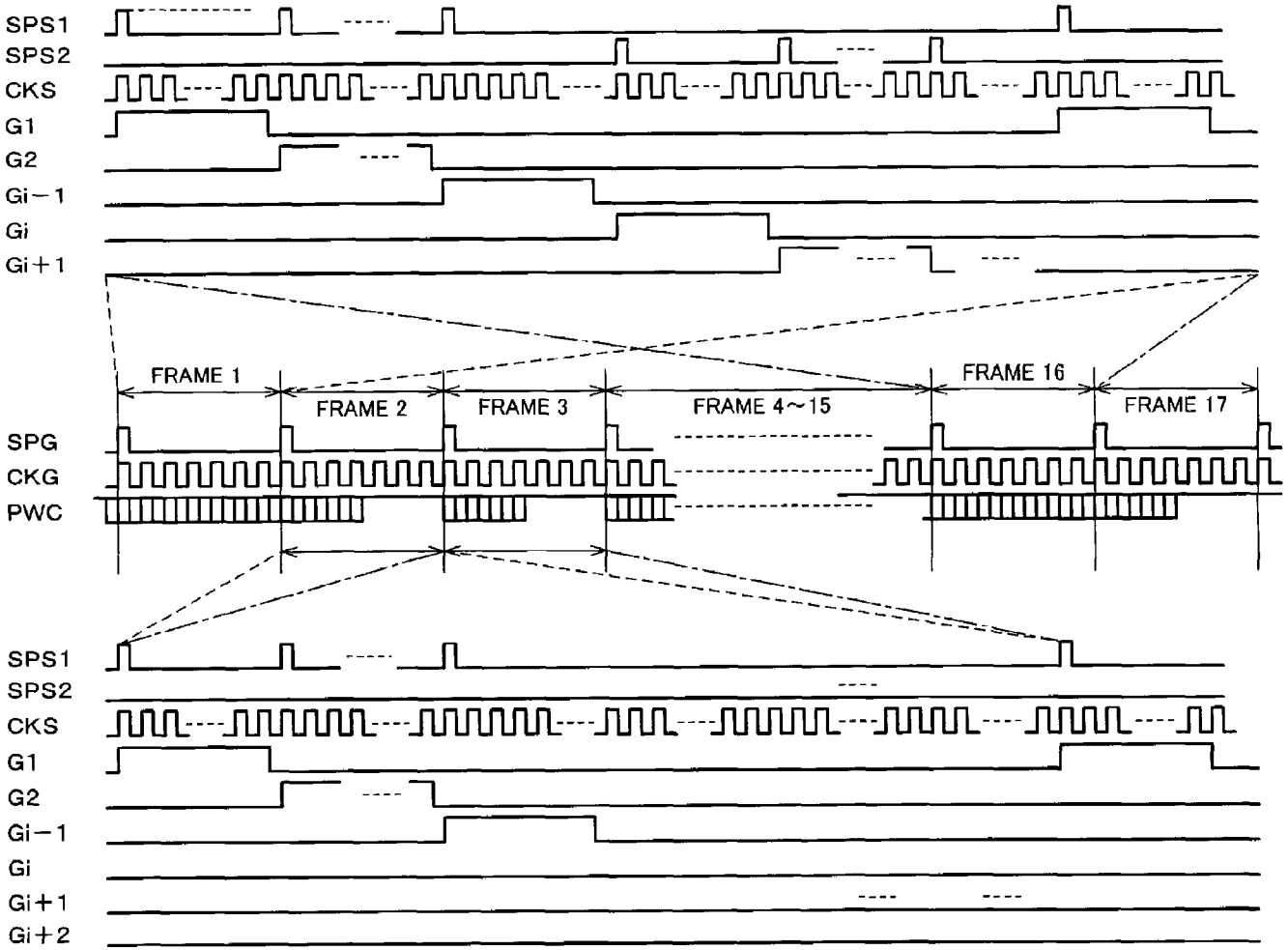
FIG. 6 illustrates waveform charts for describing a driving method for realizing the displaying illustrated in FIG. 5.

FIG. 6 illustrates waveform charts for describing the foregoing driving method. A pulse width control signal PWC supplied from the control signal generating circuit CTL is active in each frame, during periods of selecting one of the scanning signal lines G1 through Gi−1 corresponding to the partial display area P1. Accordingly, a data scanning start signal SPS1 supplied from the control signal generating circuit CTL to the data signal line drive circuit SD1 is active in each frame, during the periods of selecting one of the scanning signal lines G1 through Gi−1. For this reason, in sync with timing signals such as a clock signal CKS supplied from the control signal generating circuit CTL, an inversion signal CKSB which is inversion of the clock signal CKS, and a data scanning start signal SPS1, the data signal line drive circuit SD1 writes an image signal DAT (not illustrated) into the data signal lines S in each frame, during the periods of selecting one of the scanning signal lines G1 through Gi−1 corresponding to the partial display area P1. During the periods of selecting one of the scanning signal lines Gi through Gm corresponding to the non-display area P2, the data signal line drive circuit SD1 is stopped.

In contrast, the pulse width control signal PWC turns active once in fifteen frames (in first frame and 16th frame in FIG. 6) during the periods of selecting one of the scanning signal lines Gi-Gm corresponding to the non-display area P2. Thus, once in fifteen frames, the data signal line drive circuit SD2 writes the liquid crystal applied voltage VB or VW, indicating non-displaying and corresponding to binary image signals RGB (not illustrated), into the data signal lines S, during the periods of selecting one of the scanning signal lines Gi through Gm corresponding to the non-display area P2. This process of writing is carried out in sync with timing signals such as a clock signal CKS supplied from the control signal generating circuit CTL, an inversion signal CKSB which is inversion of the clock signal CKS, and a data scanning start signal SPS2. Also in these frames, the data signal line drive circuit SD2 is stopped during the periods of selecting one of the scanning signal lines G1 through Gi−1 corresponding to the partial display area P1.

Thus, in the partial display area P1, the image signal DAT is re-written at a refresh rate of, for instance, 15 Hz by the data signal line drive circuit SD1 and the scanning signal line drive circuit GD. In contrast, in the non-display area P2, the liquid crystal applied voltage VB or VW is re-written at a refresh rate of 1 Hz by the data signal line drive circuit SD2 and the scanning signal line drive circuit GD.

These operations are repeated so that, in the display section 12 which is divided into the partial display area P1 and the non-display area P2, the liquid crystal applied voltage VB or VW is written into the pixels corresponding to the non-display area P2 not only in the first frame but also once in every fifteen frames.

Incidentally, the frames in the present invention are determined not with respect to an image signal but with respect to an image display device, and hence, for instance, in the case of an image signal of an interlacing method, data is written into all pixels of an image display device both in odd-numbered fields and even-numbered fields, so that one field of the image signal is identical with one frame of the image display device. The following cases are examples of writing data into all pixels of the image display device both in the odd-numbered fields and the even-numbered fields; For instance, when a scanning signal line of the image display device is identical with a scanning line corresponding to one frame, data corresponding to an image signal for one line is written into two lines, and when a scanning signal line of the image display device is identical with a scanning line corresponding to one field, data corresponding to the image signal for one line is written into every other lines.

Figure 7:
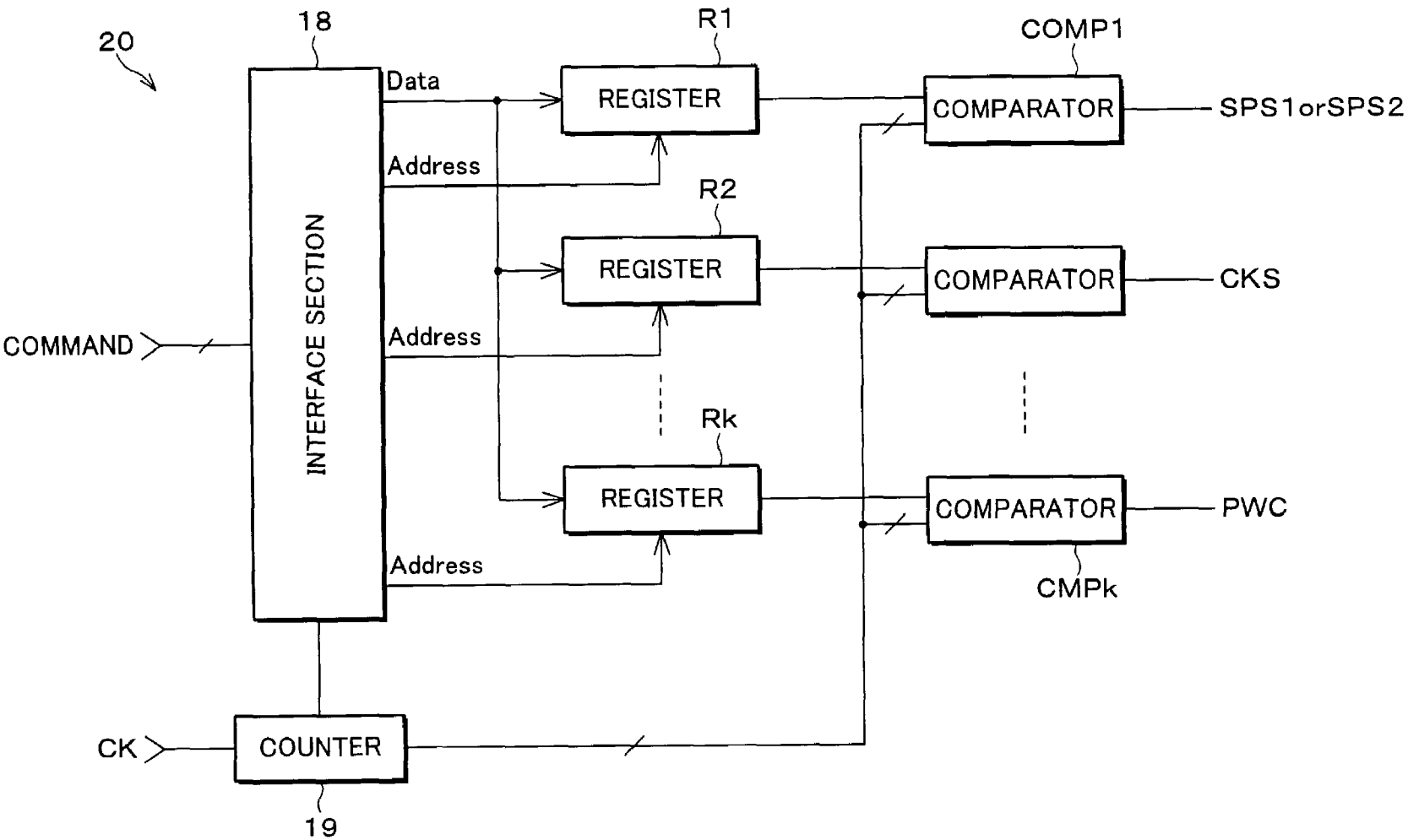
FIG. 7 is a block diagram, illustrating an electrical arrangement of a timing generator for realizing the operations illustrated in FIG. 6.

FIG. 7 is a block diagram, illustrating an electrical arrangement of a timing generator 20 for realizing the foregoing operations. This timing generator 20 is included in the control signal generating circuit CTL, so as to generate signals such as the clock signal CKS, the data scanning start signals SPS1 and SPS2, and the pulse width control signal PWC. The timing generator 20 roughly includes: an interface section 18; a counter 19; and registers R1-Rk and comparators COMP1-COMPk both corresponding to the signals such as CKS, SPS1, SPS2, and PWC.

The interface section 18 receives commands, which are supplied from the outside and give instructions such as switching between an entire screen display mode and a partial display mode, etc., so as to generate waveform shaping instruction data for specifying the timings of outputting pulses. The interface section 18 also sets the waveform shaping instruction data in the registers R1-Rk, by specifying the registers R1-Rk by address data. The counter 19 is reset by the interface section 18, so as to count clock signals CK supplied from the outside. The result of this counting is compared with the data set in the registers R1-Rk in the respective comparators COMP1-COMPk, and at timings to be active, pulses corresponding to the signals such as CKS, SPS1, SPS2, and PWC are outputted. With this arrangement, it is possible to arbitrarily set the timings of the pulses by the commands, i.e. it is possible to arbitrarily set the demarcation line between the partial display area P1 and the non-display area P2.

Thus, for instance, with respect to the pulse width control signal PWC, as a first frame and a 16th frame in FIG. 6 indicate, pulses are outputted during the periods of selecting one of the scanning signal lines G1 through Gm, in the entire screen display mode. In contrast, as a second frame through a 15th frame in FIG. 6 indicate, pulses are outputted only during the periods of selecting one of the scanning signal lines G1 through Gi−1 (G1-G7 in FIG. 6), in the partial display mode.

Consequently, the above-mentioned arrangement enables to carry out the partial displaying.

As described above, refreshing the non-display area P2 with intervals longer than those in the case of the partial display area P1 makes it possible to improve the quality of the partial displaying, even if the mobility of the active element SW is high so that the leak current on the occasion of OFF-state is large. In other words, it is possible to prevent the occurrence of a case such that the process of writing the image signal DAT into the partial display area P1 influences on the pixels in the non-display area P2 so that an inconsistent electric potential is applied to the liquid crystal in the non-display area P2 and undesirable displaying such as cross talk is generated.

Moreover, when not carrying out the writing, the data signal line drive circuits SD1 and SD2 are completely stopped without charging the data signal lines S each having a large capacity, even if the non-display area P2 has been scanned. The power consumption in the image display device on the occasion of writing binary data of the liquid crystal applied voltages VB or VW is almost identical with the power consumption on the occasion of writing multiple gray-scale data, and hence reducing the frequency of writing the binary data as much as possible enables to reduce the power consumption.

Now, a method of selecting the refresh rate of the non-display area P2 on the occasion of the foregoing partial drive is described as set forth below. It is preferable that the refresh rate is determined to be the lowest frequency, on condition that the quality of the displaying is not deteriorated. Parameters determining this quality are such as style of displaying, type of the active element SW, size of the element, driving method of the opposed electrode, liquid crystal materials, the content of displaying, and the size of the auxiliary capacitor Cs and the partial display area P1. The type of the active element is represented by the size of crystal grains in the form of amorphous, microcrystalline and polycrystalline, etc., and the size of the element is gauged by a channel length L, a channel width W, etc.

Figure 8:
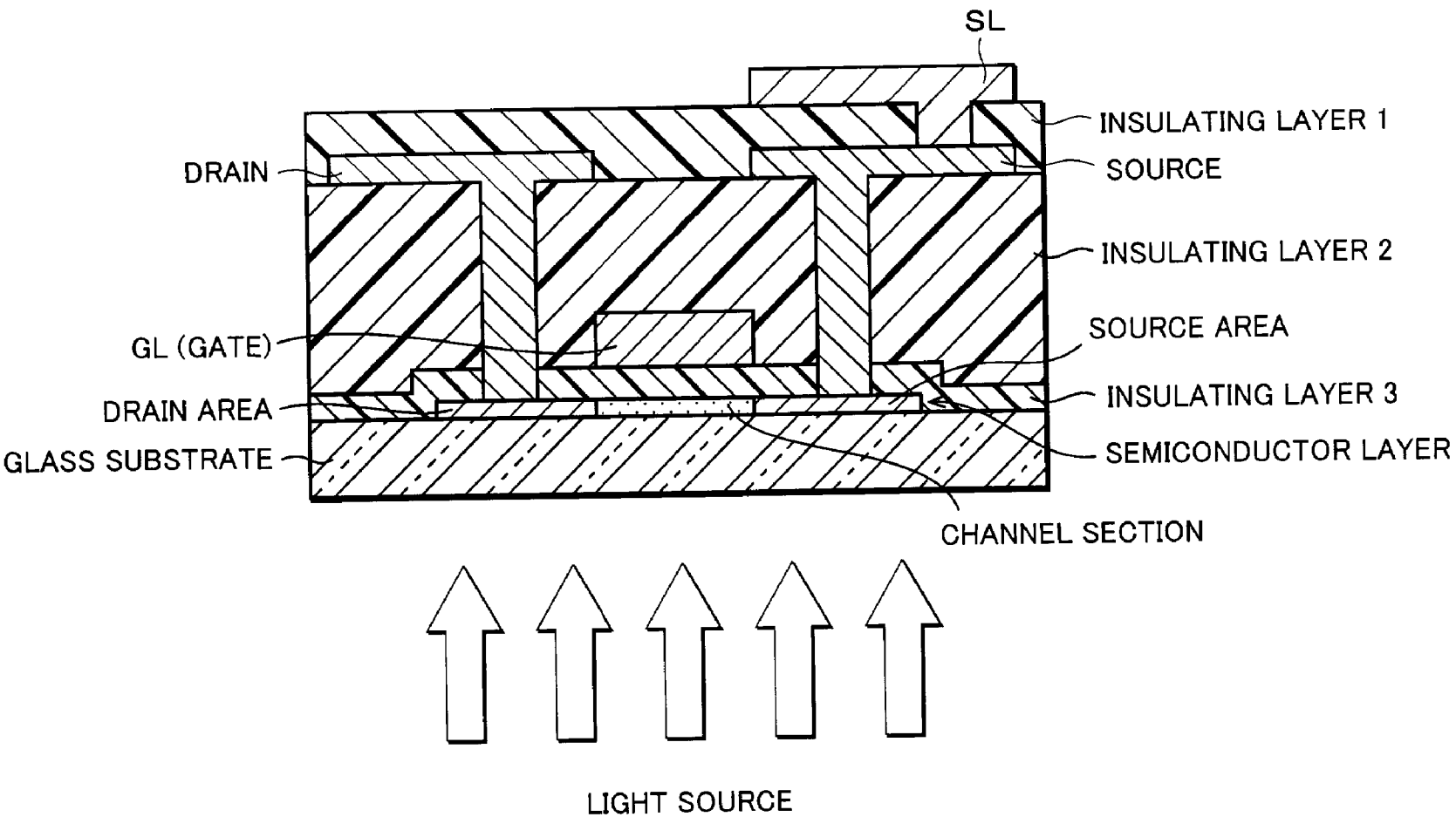
FIG. 8 is a cross section, illustrating active elements of a display panel.

The difference in the style of displaying is the difference between a transparent type and a reflective type, i.e. whether or not the backlight is adopted, and this difference has the greatest influence on the quality of displaying. More specifically, FIG. 8 is a cross section of the active element SW of the display panel. In this arrangement, on the occasion of adopting the reflective type, an incident light from the light source, which is sufficiently distant from the active element SW, enters the active element SW from the front surface (top surface in FIG. 8) thereof, so as to be reflected on the back surface of the panel and then departs from the front surface. In contrast, on the occasion of adopting the transparent type, a light entered from the back surface (bottom surface in FIG. 8) is outputted from the front surface via the panel. On this occasion, due to the photoelectric effect by a light source adopted as a backlight, the light source being extremely close to a semiconductor layer of the active element SW, an electric charge is excited in the semiconductor layer so that the electric potentials of the respective pixels are varied. This teaches that adopting the reflective type makes it possible to further reduce the refresh rate, compared to the transparent type.

Moreover, the type of the active element SW, the size of the element, and the driving method of the opposed electrode influence on the leak current when the active element SW is turned off. For instance, the larger the size of crystal grains is, e.g. amorphous, microcrystalline and polycrystalline in increasing order of size, the lower the OFF-resistance of the active element SW is, so that the leak current is increased. Further, the larger the difference of the electric potentials between the active element SW and the opposed electrode is, the larger the leak current is, and the larger the capacity of the auxiliary capacitor Cs is, the less the influence on the quality of displaying is, even if the leak current is identical. In this wise, the refresh rate of the non-display area P2 is determined in accordance with the foregoing parameters.

Next, a method of selecting a refresh timing using the refresh rate determined by the foregoing method is described as set forth below. On the occasion of carrying out frame-reversal drive, the partial display area P1 is refreshed in every frame so that the pixels PIX are not fixed to a particular polarity. However, the non-display area P2 is not refreshed in every frame, and thus the pixels PIX could be refreshed only with a particular polarity, on occasions when the pixels PIX are refreshed at a refresh rate of even intervals. For this reason, it is necessary to adjust the refresh timings in order to prevent the non-display area P2 to be refreshed only with a particular polarity. Incidentally, on occasions such as carrying out line-reversal drive and dot-reversal drive, it is not necessary to adjust the refresh timings, on condition that the polarity of the pixels PIX is reversed in each frame.

Now, provided that positive polarity is applied in odd frames, negative polarity is applied in even frames, and frame frequency (full frame frequency) of the partial display area P1 is 60 Hz, Table. 1 illustrates the refresh polarities of the non-display area P2 at the refresh rate of even intervals, except some frames are skipped at random, and Table. 2 illustrates the refresh polarities of the non-display area P2 at the refresh rate of even intervals, when frames are skipped in view of the refresh polarity of the previous frames.

TABLE 1

| FRAME NUMBER | | 1 | 2 | 3 | 4 | 5 | 6 | 7 | 8 | 9 | 10 | 11 | 12 | 13 | 14 | 15 | 16 | 17 | RESULT |
|---|---|---|---|---|---|---|---|---|---|---|---|---|---|---|---|---|---|---|---|
| FRAME FREQUENCY | 60 | + | − | + | − | + | − | + | − | + | − | + | − | + | − | + | − | + | OK |
| | 50 | + | − | + | − | + | | + | − | + | − | + | | + | − | + | − | + | NG |
| | 40 | + | − | | − | + | | + | − | | − | + | | + | − | | − | + | OK |
| | 30 | + | | + | | + | | + | | + | | + | | + | | + | | + | NG |
| | 20 | + | | | − | | | + | | | − | | | + | | | − | | OK |
| | 15 | + | | | | + | | | | + | | | | + | | | | + | NG |
| | 10 | + | | | | | − | | | | | + | | | | | − | | OK |
| | 8 | + | | | | | | | | + | | | | | | | | + | NG |
| | 5 | + | | | | | | | | | | | | + | | | | | NG |

TABLE 2

| FRAME NUMBER | | 1 | 2 | 3 | 4 | 5 | 6 | 7 | 8 | 9 | 10 | 11 | 12 | 13 | 14 | 15 | 16 | 17 | RESULT |
|---|---|---|---|---|---|---|---|---|---|---|---|---|---|---|---|---|---|---|---|
| FRAME FREQUENCY | 60 | + | − | + | − | + | − | + | − | + | − | + | − | + | − | + | − | + | OK |
| | 50 | + | − | + | − | + | | − | + | − | + | − | | + | − | + | − | + | OK |
| | 40 | + | − | | + | − | | − | + | | − | + | | + | − | | + | − | OK |
| | 30 | + | | − | | + | | − | | + | | − | | + | | − | | + | OK |
| | 20 | + | | | − | | | + | | | − | | | + | | | − | | OK |
| | 15 | + | | | | − | | | | + | | | | − | | | | + | OK |
| | 10 | + | | | | | − | | | | | + | | | | | − | | OK |
| | 8 | + | | | | | | | | − | | | | | | | | + | OK |
| | 5 | + | | | | | | | | | | | | − | | | | | OK |

As Table. 1 clearly illustrates, when the frame frequency is 30 Hz and 15 Hz, which are a half and a quarter of the aforementioned frame frequency of the partial display area P1, respectively, positive polarity is kept every time the refreshing is carried out. Also in the cases of 50 Hz, 8 Hz, and 5 Hz, positive polarity is kept every time. Thus, even if the refreshing rate is determined as above, it is not possible to simply adopt these frame frequencies of the non-display area P2 to the liquid crystal display device for carrying out the frame-reversal drive.

Thus, as Table. 2 illustrates, it is possible to prevent the unbalance of polarities on the occasion of the refreshing by altering polarities of some frames, provided that a certain number of frame periods, e.g. 16 frame periods, is considered as one unit. That is to say, when the frame frequency of the non-display area P2 is 50 Hz, polarities of frames 7-11 are reversed. Similarly, when the frame frequency is 30 Hz, polarities of frames 3, 7, 11, and 15 are reversed, when the frame frequency is 15 Hz, polarities of frames 5 and 13 are reversed, when the frame frequency is 8 Hz, polarity of a frame 9 is reversed, and when the frame frequency is 5 Hz, polarity of a frame 13 is reversed.

When the frame frequency is 40 Hz, polarities of respective frames 4, 5, 7, 8, 16, and 17 are reversed. Thus, the polarities are arranged so as not to be either positive or negative for a long period of time. Alternatively, the frames may be skipped at uneven intervals, rather than reversing the polarities of the frames. In this case, the polarity could be unchanged for a long period of time, but the frames can keep the inherent polarities and this makes it possible to simplify the control.

Figure 19:
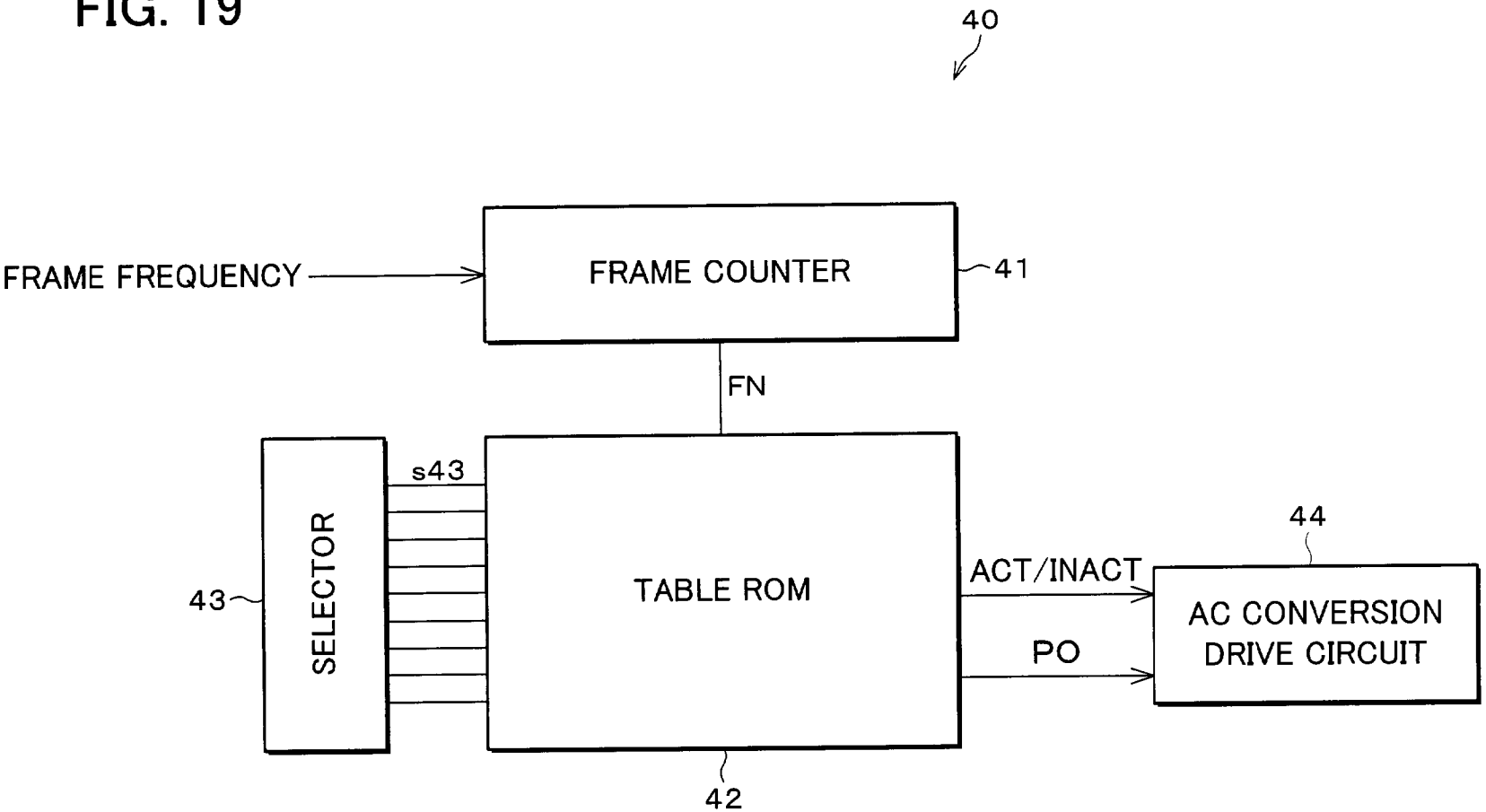
FIG. 19 is a block diagram, illustrating a first arrangement of a circuit for carrying out the reverse of polarity, provided in the display device of an embodiment of the present invention.

For carrying out the reversal of polarities as illustrated in Table. 2, the data related to the reversal of polarities (e.g. data in accordance with Table. 2) is stored as a look-up table, and this data is read out from the look-up table as the need arises. The look-up table is read out using a polarity setting circuit (polarity setting means) 40 whose arrangement is illustrated in FIG. 19. The polarity setting circuit 40 stores a series of setting polarities in advance, so that polarities for writing in the non-display area P2 are arranged so as to correspond to the previous polarities for writing. The polarity setting circuit 40 is provided with: a frame counter 41; a table ROM 42; a selector 43; and an AC conversion drive circuit 44.

The frame counter 41 carries out counting in accordance with the frame frequency, and inputs the frame number (FN in FIG. 19) into the table ROM (look-up table) 42. The selector 43 is provided for selecting the corresponding frame frequency, so that a signal s43 selected by the selector 43 is supplied to the table ROM 42. Then the table ROM 42 outputs (i) a polarity signal PO and (ii) a signal ACT/INACT, which specifies whether or not a drive signal of positive or negative polarity is generated in accordance with the polarity signal PO, to the AC conversion drive circuit 44, following the receipt of the frame number (FN) and the signal s43 from the selector 43.

Figure 20:
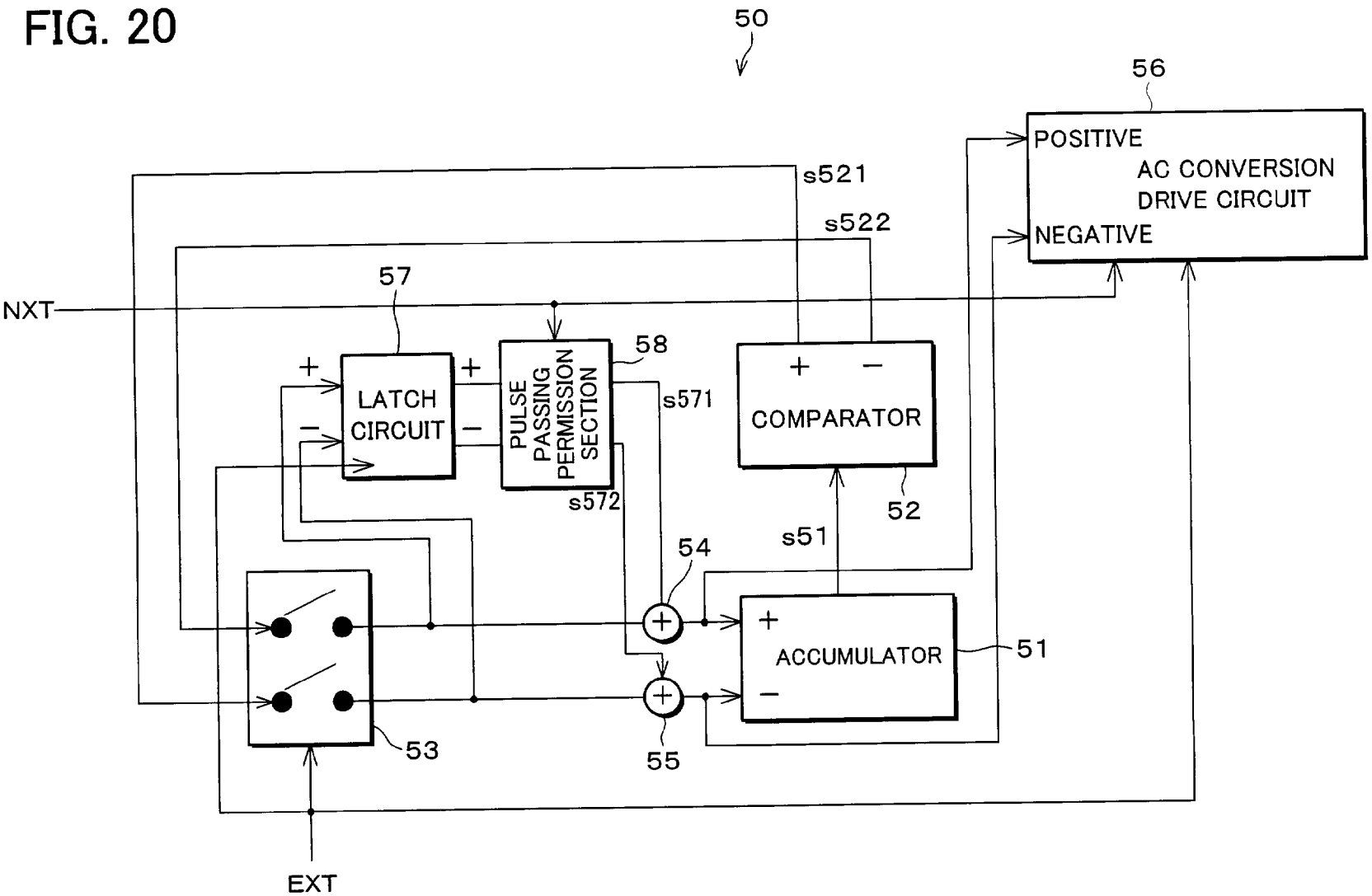
FIG. 20 is a block diagram, illustrating a second embodiment of a circuit for carrying out the reverse of polarity, provided in the display device of an embodiment of the present invention.

Alternatively, it is possible to automatically carry out the reversal of polarities, without using the look-up table. FIG. 20 illustrates a polarity self-adjustment circuit (polarity setting means, polarity self-adjustment means) 50 for realizing the automatic reversal of polarities. The polarity self-adjustment circuit 50 automatically adjusts the polarities for writing, in accordance with the polarities of the previous writings. The polarity self-adjustment circuit 50 is provided with: an accumulator 51; a comparator 52; a switch 53; adders 54 and 55; an AC conversion drive circuit 56; a latch circuit 57; and a pulse passing permission section 58.

When an output signal s51 from the accumulator 51 is supplied to the comparator 52 and the output signal s51 is not less than 0, an active signal s521 is outputted from a plus terminal of the comparator 52. When the output signal s51 is less than 0, an active signal s522 is outputted from a minus terminal of the comparator 52. The signal (the active signal s521 or the active signal s522) outputted from the comparator 52 is supplied to the accumulator 51 and the AC conversion drive circuit 56 via the switch 53 and the adders 54 and 55.

When the active signal s521 is outputted from the plus terminal of the comparator 52, a minus terminal of the accumulator 51 receives the active signal s521, so that "−1" is counted. When the active signal s522 is outputted from the minus terminal of the comparator 52, a plus terminal of the accumulator 51 receives the active signal s522, so that "+1" is counted. When the plus terminal of the accumulator 51 receives the active signal, the AC conversion drive circuit 56 generates a drive signal of positive polarity, and when the minus terminal of the accumulator 51 receives the active signal, the AC conversion drive circuit 56 generates a drive signal of negative polarity.

Here, in the frame periods of not carrying out the refreshing, a scanning operation timing signal EXT turns inactive so that the switch 53 is turned off. At this moment, although the scanning operation timing signal EXT is also supplied to the AC conversion drive circuit 56 and the latch circuit 57, the latch circuit 57 stores a signal (active signal s521 or s522) supplied from the comparator 52 on the previous occasion. When a scanning non-operation timing signal NXT turns active, a signal (either an active signal s571 supplied to the adder 54 or an active signal s572 supplied to the adder 55) from the latch circuit 57 is supplied to the accumulator 51 and the AC conversion drive circuit 56 via the pulse passing permission section 58. The pulse passing permission section 58 permits signals to pass through, when the scanning non-operating timing signal NXT is active.

When a plus terminal of the latch circuit 57 stores the active signal s522, the plus terminal of the accumulator 51 receives the active signal again, so that "+1" is counted. In contrast, when a minus terminal of the latch circuit 57 stores the active signal s521, the active signal is supplied to the minus terminal of the accumulator 51 again, so that "−1" is counted. Although an output signal (active signal s571 or s572) is also supplied to the AC conversion drive circuit 56, the AC conversion drive circuit 56, which receives the scanning non-operation timing signal NXT, does not generate the drive signal, since the scanning non-operation timing signal NXT is active.

Now, provided that the frame frequency is 60 Hz in the arrangement illustrated in FIG. 20 (i.e. there are no periods of not carrying out the refreshing), since the scanning operation timing signal is always active, the drive signal generated by the AC conversion drive circuit 56 is arranged so as to be: −, +, −, +, −, +, −, +, −, +, −, +, −, +, −, +, on condition that the initial value of the accumulator 51 is 0. In short, it is obvious that the time for keeping the positive polarity is equal to the time for keeping the negative polarity.

Provided that the frame frequency is 40 Hz (as in the arrangement of Table. 2, the refreshing is not carried out in the frames 3, 6, 9, 12, and 15), the scanning operation timing signal EXT is active in the frames 1, 2, 4, 5, 7, 8, 10, 11, 13, and 14, and the scanning non-operation timing signal NXT is active in the frames 3, 6, 9, 12, and 15. Thus, if the initial value of the accumulator 51 is 0, the drive signal generated by the AC conversion drive circuit 56 is arranged so as to be: −, +, (+), −, −, (−), +, +, (+), −, −, (−), +, +, (+), −. "(+)" and "(−)" indicate that even though the AC conversion drive circuit 56 is not driven, the polarity of the drive signal in the previous frame has been kept as it is. Also in this case, the time for keeping the positive polarity is equal to the time for keeping the negative polarity.

Provided that the frame frequency is 30 Hz (as in the arrangement of Table. 2, the refreshing is not carried out in the frames 2, 4, 6, 8, 10, 12, 14, and 16), the scanning operation timing signal EXT is active in the frames 1, 3, 5, 7, 9, 11, 13, and 15, and the scanning non-operation timing signal NXT is active in the frames 2, 4, 6, 8, 10, 12, 14, and 16. Thus, if the initial value of the accumulator 51 is 0, the drive signal generated by the AC conversion circuit 56 is arranged so as to be: −, (−), +, (+), −, (−), +, (+), −, (−), +, (+), −, (−), +, (+). "(+)" and "(−)" indicate that even though the AC conversion drive circuit 56 is not driven, the polarity of the drive signal in the previous frame has been kept as it is. Also in this case, the time for keeping the positive polarity is equal to the time for keeping the negative polarity, and this holds true with the cases of other frame frequencies.

Both by the method of using the look-up table and the method of automatically carrying out the reversal of polarities, it is possible to prevent the unbalance of polarities on the occasion of the refreshing, provided that a certain number of frame periods, e.g. 16 frame periods, is considered as one unit. The method of using the look-up table is superior in avoiding the continuation of an identical polarity as in the case when the frame frequency is 40 Hz, and hence this method is superior in improving the quality of displaying. In other words, during the 16 frame periods, the continuation of an identical polarity for three successive periods is carried out twice in the method of using the look-up table, while the continuation of an identical polarity for three successive periods is carried out four times in the method of automatically carrying out the reversal of polarities.

To differentiate the refresh frequencies in different areas of the display section by using the look-up table, only one circuit arrangement illustrated in FIG. 19 is required. That is to say, the frame frequencies used in the respective areas are switched by the selector 43. In contrast, when the differentiation is carried out using the method of automatically carrying out the reversal of polarities, more than one circuit arrangement illustrated in FIG. 20 could be needed. For instance, when the frame frequency in one area is 60 Hz and the frame frequency in the other area is 30 Hz, only one circuit arrangement is required because it is not necessary to provide the circuit in FIG. 20 in the area of 60 Hz. However, when the frame frequency in one area is 40 Hz and the frame frequency in the other area is 30 Hz, it is necessary to provide the circuit in each of the areas.

When the method of using the look-up table is adopted, for accommodating to various frame frequencies, it is necessary to increase the capacity of a memory. In contrast, the method of automatically carrying out the reversal of polarities is superior in accommodating to various frame frequencies, since it is unnecessary to change the circuit arrangement.

In this manner, it is possible to prevent the degradation of the quality of displaying, even if the frame-reversal drive is carried out. The foregoing arrangements are not limited to the partial drive, so that they can be adopted to all kinds of attempts to reduce frame frequency from the full frame frequency, in order to reduce the power consumption.

In the foregoing arrangements, the reversal of polarities is carried out for equalizing the periods of positive polarity and the periods of negative polarity as much as possible. This aims at restraining the difference between the effective value of one polarity and the effective value of the other polarity to be not more than a predetermined value during a period of applying a voltage to the pixels in the non-display area P2, on the occasion of carrying out intermittent writing into the pixels with both polarities.

On the occasion of actual drive of the liquid crystal display device, provided that a positive voltage value of the voltage applied to the pixel electrode is V+, a negative voltage value is V−, and a voltage applied to an opposed substrate via liquid crystal materials is VCOM, respective voltages applied to the liquid crystal on the positive and negative sides are Vpix+=|VCOM−V+| and Vpix−=|VCOM−V−|, when displaying is uniformly carried out on the entire screen. When the voltage of the periods of positive polarity is identical with the voltage of the periods of negative polarity, ΔVpix=(Vpix+)−(Vpix−)=0, i.e. Vpix+=Vpix−. On this occasion, it is preferable that ΔVpix<150 mV, in the light of the reliability of liquid crystal materials. When flicker occurs on the screen because of a large value of ΔVpix, it is preferable that the allowable range of ΔVpix is set so as not to cause the flicker, in view of the quality of the displaying. Thus, on the occasion of the reversal of polarities in order to cause the voltage of the periods of positive polarity to be almost identical with the voltage of the periods of negative polarity, the difference between the effective value of one polarity and the effective value of the other polarity is generally restrained so as to be not more than a predetermined value, on the ground of not only the periods of respective polarities but also the magnitude of the voltages.

Setting the predetermined value to be small makes it possible to carry out the intermittent writing without the unbalance of the polarities. For this reason, even if the refresh rate on the occasion of the writing is low, it is possible to carry out the drive of the pixels with the reversal of polarities in order to restrain the degradation of the liquid crystal materials, and this drive can be carried out without causing the flicker.

Embodiment 2

Referring to figures, the following description will discuss another embodiment in accordance with the present invention.

Figure 9:
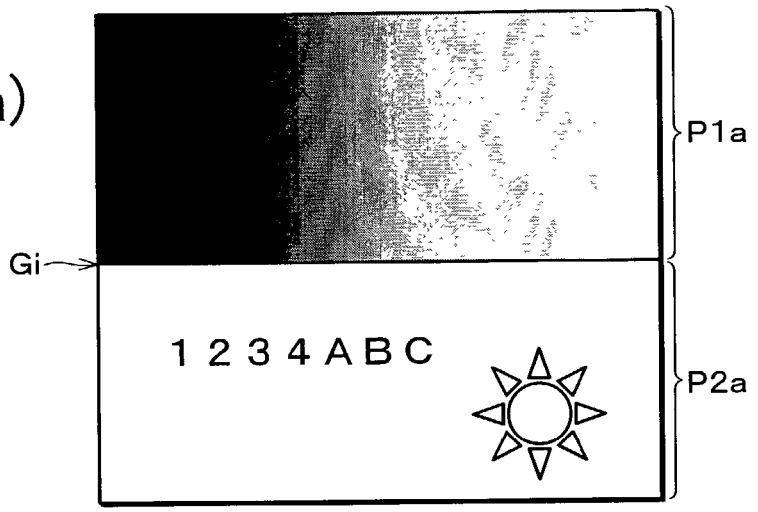
FIGS. 9(*a*)-9(*c*) show examples of the displaying by a liquid crystal display device which is a display device in accordance with another embodiment of the present invention.
Figure 9:
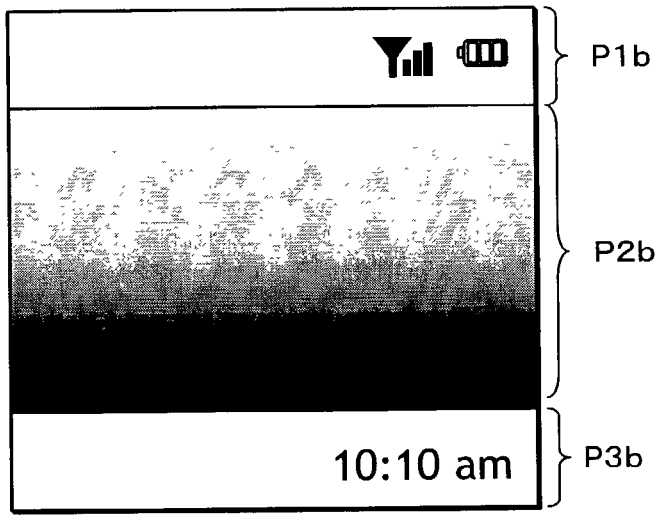
Figure 9:
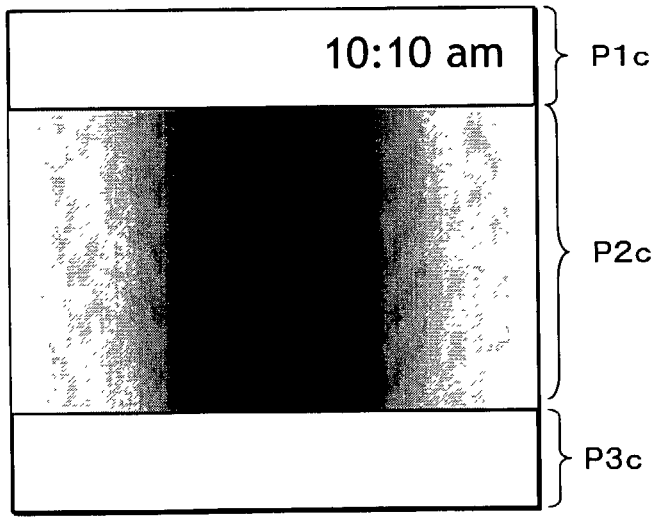

FIG. 9(*a*) shows an example of displaying by a liquid crystal display device which is a display device in accordance with another embodiment of the present invention. In this Embodiment 2, it is possible to adopt the foregoing liquid crystal display device 11. While the image signals RGB are used as the data for causing the non-display area P2 of the liquid crystal display device 11 to be non-displaying in Embodiment 1, these image signals RGB are also used as the data for displaying in Embodiment 2.

In Embodiment 1, for instance, among the liquid crystal applied voltages VB and VW, either one of the voltages, which specifies non-displaying with respect to the electric potential of the opposed electrode, is selected in accordance with the image signals RGB in a frame to be refreshed, for instance, on occasions when neither the line-reversal drive nor the dot-reversal drive are carried out. In contrast, in Embodiment 2, among the liquid crystal applied voltages VB and VW, the other voltage which specifies displaying with respect to the electric potential of the opposed electrode is also selected.

That is to say, as illustrated in FIG. 9(*a*), the example of displaying in accordance with Embodiment 2 is arranged in such a manner that the area of the scanning signal lines G1 through Gi−1 is set as a multiple gray-scale display area P1*a*, and the area of the scanning signal lines Gi through Gm is set as a binary display area P2*a*. In the binary display area P2*a*, provided that a voltage applied to pixels to be non-displaying is the foregoing voltage VW, it is possible to display an image of 2 gray scales on the binary display area P2*a*, with the arrangement such that the voltage applied to pixels to be displaying is VB.

Subsequently, the refresh rate of the binary display area P2*a* is arranged so as to be lower than the refresh rate of the multiple gray-scale display area P1*a*, so that the reduction of the power consumption can be achieved, along with the prevention of the degradation of the quality of displaying.

Figure 10:
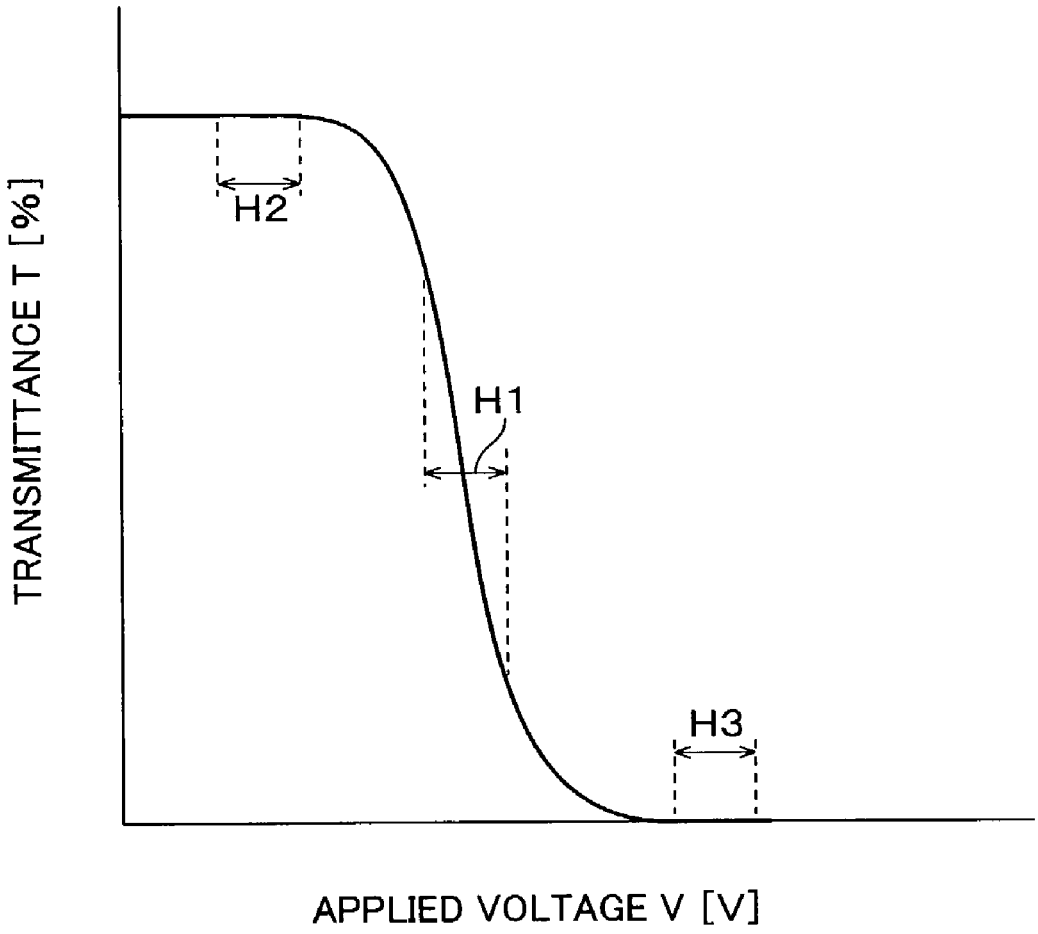
FIG. 10 is a graph, indicating the relationship between a voltage applied to liquid crystal and transmittance.

The following is the reason why the degradation of the quality of displaying can be prevented, even if the refresh rate of the binary display area P2*a* is arranged so as to be lower than the refresh rate of the multiple gray-scale display area P1*a*. FIG. 10 indicates the relationship between a voltage V applied to the liquid crystal and transmittance T. The multiple gray-scale display area P1*a* corresponds to a linear section H1 indicating that the transmittance T varies in accordance with the voltage V, and the binary display area P2*a* corresponds to non-linear sections H2 and H3 indicating that the transmittance T scarcely varies even if the voltage V varies to some extent. For this reason, even if the refresh rate of the binary display area P2*a* is arranged so as to be lower than the refresh rate of the multiple gray-scale area P1*a*, the quality of displaying is not really degraded.

In this arrangement, the data signal line drive circuit SD2 outputs the liquid crystal applied voltage VB or VW to the data signal lines S in accordance with the image signals RGB of 2 gray scales. Thus, the liquid crystal display device 11 is arranged so as to be suitable for display devices of, for instance, mobile phones, since the device 11 can exhibit excellent display quality by means of the data signal line drive circuit SD1 when in-service, while the device 11 can realize minimum displaying with relatively low quality by means of the data signal line drive circuit SD2 when standby.

Embodiment 3

Referring to figures, the following description will discuss a further embodiment in accordance with the present invention.

Figure 11:
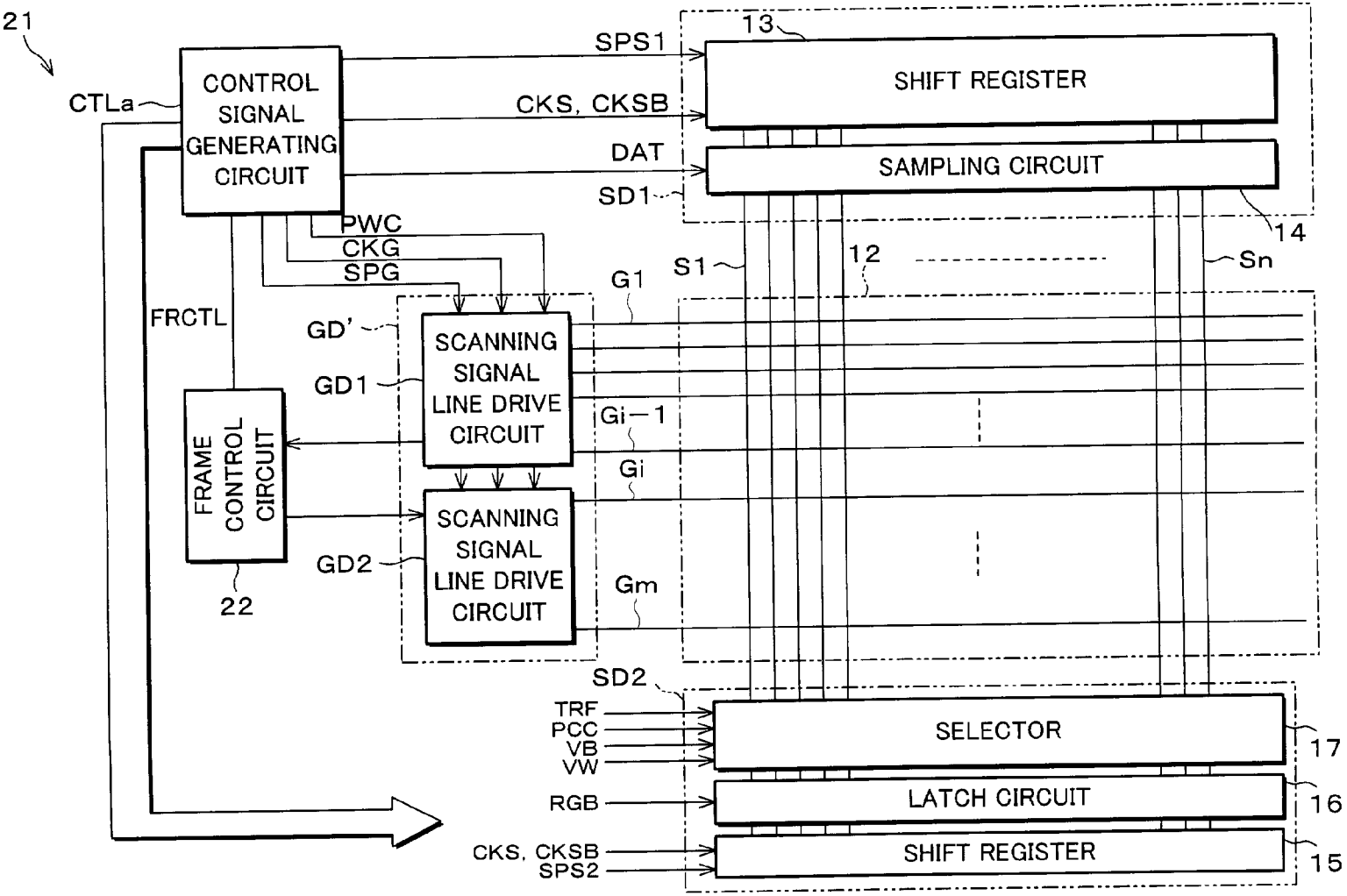
FIG. 11 is a block diagram, illustrating an electrical arrangement of a liquid crystal display device which is a display device in accordance with a further embodiment of the present invention.

FIG. 11 is a block diagram, illustrating an electrical arrangement of a liquid crystal display device 21 which is a display device in accordance with a further embodiment of the present invention. This liquid crystal display device 21 is similar to the foregoing liquid crystal display device 11, and hence corresponding members are given the same numbers so that the descriptions are omitted for the sake of simplicity.

This liquid crystal display device 21 is arranged in such a manner that a scanning signal line drive circuit GD' is divided into two scanning signal line drive sections GD1 and GD2 each capable of operating either independently or in sync with each other. According to these scanning signal line drive sections GD1 and GD2, a frame control signal FRCTL is supplied from a control signal generating circuit CTLa to a frame control circuit 22. The frame control circuit 22 responds to the output from the scanning signal line drive section GD1 so as to control the scanning signal line drive section GD2. The clock signal CKG, the data scanning start signal SPG, and the pulse width control signal PWC are commonly supplied to the scanning signal line drive sections GD1 and GD2.

Figure 12:
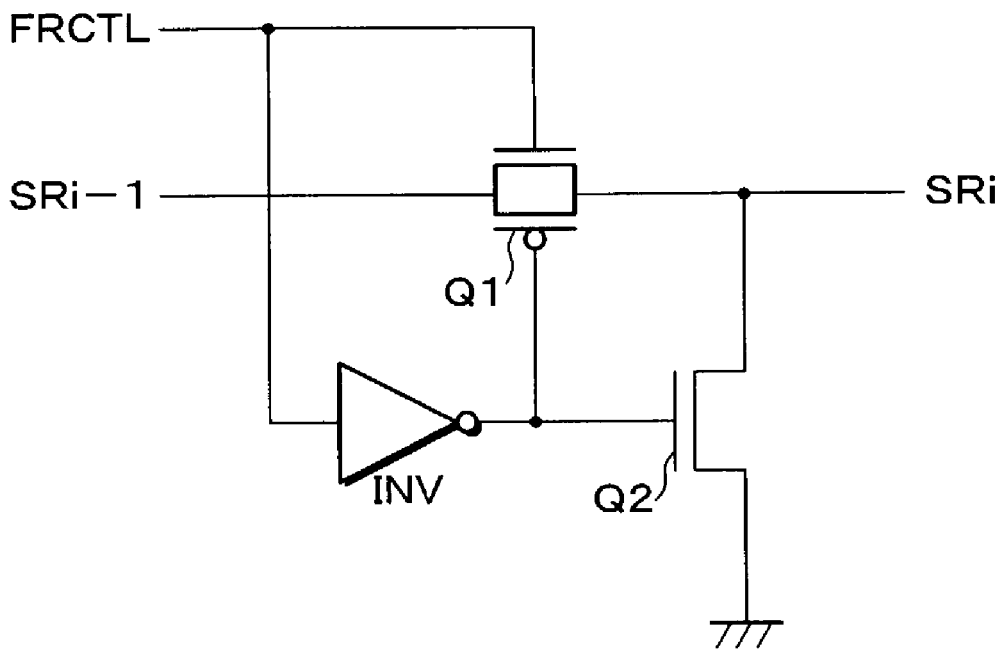
FIG. 12 is a circuit diagram, illustrating an arrangement of a frame control circuit of the liquid crystal display device of FIG. 11.

FIG. 12 is a circuit diagram, illustrating an arrangement of the frame control circuit 22. This frame control circuit 22 is provided with: an analog switch Q1 composed of a P-type FET and an N-type FET provided in a serial manner; an inverter INV for driving the analog switch Q1; and a switch Q2 composed of an N-type FET. The frame control signal FRCTL is directly supplied to the gate of the N-type FET of the analog switch Q1, and after being inverted by the inverter INV, the signal FRCTL is also supplied to the gate of the P-type FET. The source of the analog switch Q1 receives a transferred pulse supplied from a shift register SRi−1 which is the last stage and corresponds to a scanning signal line Gi−1 of the scanning signal line drive section GD1, and from the drain of the analog switch Q1, the transferred pulse is outputted to a shift register SRi which is the first stage and corresponds to a scanning signal line Gi of the scanning signal line drive section GD2. The drain of the analog switch Q1 is also connected to the drain of the switch Q2. The source of the switch Q2 is grounded, and the gate thereof receives the frame control signal FRCTL being inverted by the inverter INV.

In the frame control circuit 22 with the foregoing arrangement, when the frame control signal FRCTL turns active (in the high-level), the analog switch Q1 is turned on while the switch Q2 is turned off. This causes the transferred pulse from the shift register SRi−1 to be outputted to the register SRi. In contrast, when the frame control signal FRCTL turns inactive (in the low-level), the analog switch Q1 is turned off while the switch Q2 is turned on. This prohibits the supply of the transferred pulse from the shift register SRi−1 to the shift register SRi.

Figure 13:
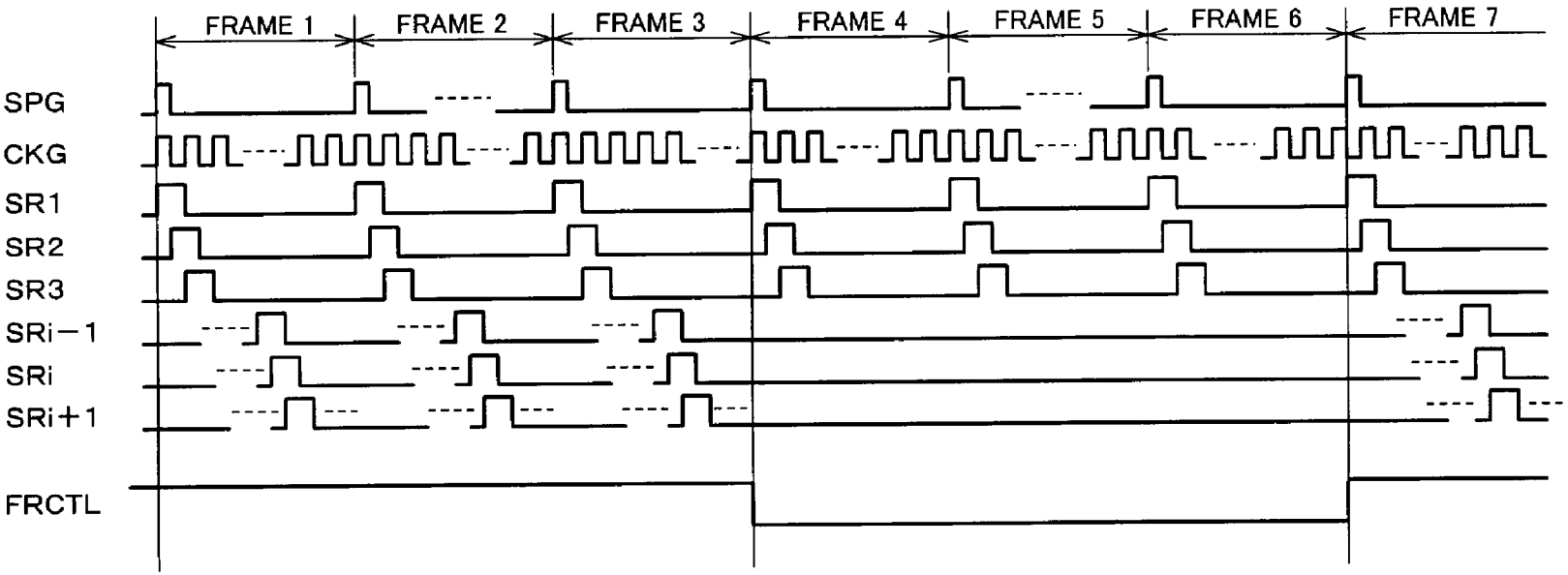
FIG. 13 illustrates waveform charts for describing an example of the drive of the liquid crystal display device of FIG. 11.

FIG. 13 illustrates waveform charts for describing an example of the drive of the liquid crystal display device 21 with the foregoing arrangement. In this figure, the conditions of respective cells in the shift registers of the scanning signal line drive sections GD1 and GD2 are indicated such as SR1, . . . , SRi−1, SRi, and SRi+1.

The frame control signal FRCTL is active during the frames 1-3, and during these frames, both of the multiple gray-scale display area P1*a* and the binary display area P2*a* are refreshed. In contrast, during the frames 4-6, the frame control signal FRCTL is inactive so that only the multiple gray-scale display area P1*a* is refreshed. In the frame 7, the frame control signal FRCTL turns active again.

For this reason, in the event that the multiple gray-scale area P1*a* and the binary display area P2*a*, which are illustrated in FIG. 9(*a*), are bordered with a predetermined scanning signal line (between the scanning signal lines Gi−1 and Gi in the cases of FIGS. 12 and 13), the frame control signal FRCTL is caused to be inactive during the period of not refreshing the binary display area P2*a*, so that processes such as the transfer by the shift register in the scanning signal line drive section GD2 and the output of a select voltage to the scanning signal lines Gi-Gm are not carried out. On this account, the power consumption is further reduced.

FIG. 9(*a*) illustrates the arrangement of displaying in which the display section is divided into the binary display area P1*a* and the multiple gray-scale display area P2*a*. However, in the present invention, the display section may be divided into a binary display area P1*b*, a multiple gray-scale display area P2*b*, and a binary display area P3*b*, as illustrated in FIG. 9(*b*).

Here, in addition to the aforementioned arrangement of the refresh rate in consideration of the degradation of the quality of displaying, a case such as displaying a flashing colon (:) for briefly counting seconds in a clock on the screen will be described. In this case, it is enough to re-write only the flashing portion of the displaying, so that the binary display area P3*b* is refreshed in each second, i.e. at 1 Hz. On this occasion, it is possible to arrange that the data of the area P1*b* is re-written at 10 Hz and the image displayed on the area P2*b* is rewritten at 60 Hz like a television picture. Thus, in this arrangement, the binary display area P1*b*, the multiple gray-scale display area P2*b*, and the binary display area P3*b* have each different refresh rate. In this manner, as long as the pixels permit to freely arrange the periods for refreshing, one display section may be divided into a plurality of areas each having different refresh rate for displaying.

Moreover, as illustrated in FIG. 9(*c*), there is such an alternative arrangement that the display section is divided into a binary display area P1*c*, a multiple gray-scale display area P2*c*, and a non-display area P3*c*, each having different refresh rate. Further, the display section may be divided into four areas rather than three areas. At any rate, it is possible to realize these arrangements on condition that either the pulse width control signal PWC supplied to the scanning signal line drive circuit GD illustrated in FIG. 3 or the frame control signal FRCTL supplied to the frame control circuit 22 illustrated in FIG. 11 is adjusted to be suitable for displaying, by the respective arrangements.

In the arrangements illustrated in respective FIGS. 9(*a*) and 9(*c*), three areas of the display section have each different refresh rate. However, any two of these three areas may have an identical refresh rate. More specifically, for instance, in FIG. 9(*b*), the refresh rate of the binary display area P1*b* and the binary display area P3*b* is 10 Hz, and the refresh rate of the multiple gray-scale display area P2*b* is 60 Hz. In this case, the timings of the writing are not necessarily identical, so that frames for the writing in the binary display area P1*b* may be different from frames for the writing in the binary display area P3*b*.

This holds true with the display section divided into not less than four areas. Provided that the display section is divided into areas P1*d*, P2*d*, P3*d*, and P4*d* (these areas are not illustrated), some of these areas may have an identical refresh rate. For instance, the refresh rate of the areas P1*d* and P4*d* is 1 Hz, the refresh rate of the area P2*d* is 10 Hz, and the refresh rate of the area P3*d* is 60 Hz. Moreover, the timings of the writing in the area P1*d* may be different from those in the area P4*d* so that the writings in these areas may be carried out in different frames.

Furthermore, there are such alternative examples that the refresh rate of the areas P1*d* and P3*d* is 10 Hz and the refresh rate of the areas P2*d* and P4*d* is 60 Hz, and frames for the writing in the area P1*b* are different from frames for the writing in the area P3*b*, and frames for the writing in the area P2*b* are different from frames for the writing in the area P4*b*. It is noted that the present invention is not limited to the foregoing examples.

Although FIG. 11 illustrates the scanning signal line drive circuit GD divided into two scanning signal line drive sections, the present invention is not limited to this arrangement so that the scanning signal line drive circuit GD may be divided into not less than three scanning signal line drive sections. On this occasion, at least two frame control circuits 22 are provided and the frame control signal FRCTL is supplied to both of the circuits 22.

Provided that respective scanning signal line drive sections are termed GD11, GD12, and GD13, a frame control signal supplied to a frame control circuit provided between the scanning signal line drive sections GD11 and GD12 is termed FRCTL1, and a frame control signal supplied to a frame control circuit provided between the scanning signal line drive sections GD12 and GD13 is termed FRCTL2 (this arrangement is not illustrated), the frame control signals FRCTL1 and the FRCTL2 are caused to be in the low-level when only the scanning signal line drive section GD11 is activated in a frame. When only the scanning signal line drive sections GD11 and GD12 are activated, the frame control signal FRCTL1 is caused to be in the high-level and the frame control signal FRCTL2 is caused to be in the low-level. When all of the scanning signal line drive sections GD11, GD12, and GD13 are activated, both of the frame control signals FRCTL1 and FRCTL2 are caused to be in the high-level.

Provided that the shift register used in the scanning signal line drive circuit is a bi-directional shift register, it is possible to input the data scanning start signal SPG from the scanning signal line drive section GD13, rather than from the scanning signal line drive section GD11. In this case, in order to activate only the scanning signal line drive section GD13, the frame control signals FRCTL1 and FRCTL2 are caused to be in the low-level. When only the scanning signal line drive sections GD12 and GD13 are activated, the frame control signal FRCTL1 is caused to be in the low-level and the frame control signal FRCTL2 is caused to be in the high-level. This also holds true with a scanning signal line drive circuit divided into not less than four scanning signal line drive sections.

Embodiment 4

Referring to figures, the following description will discuss yet another embodiment in accordance with the present invention.

Figure 14:
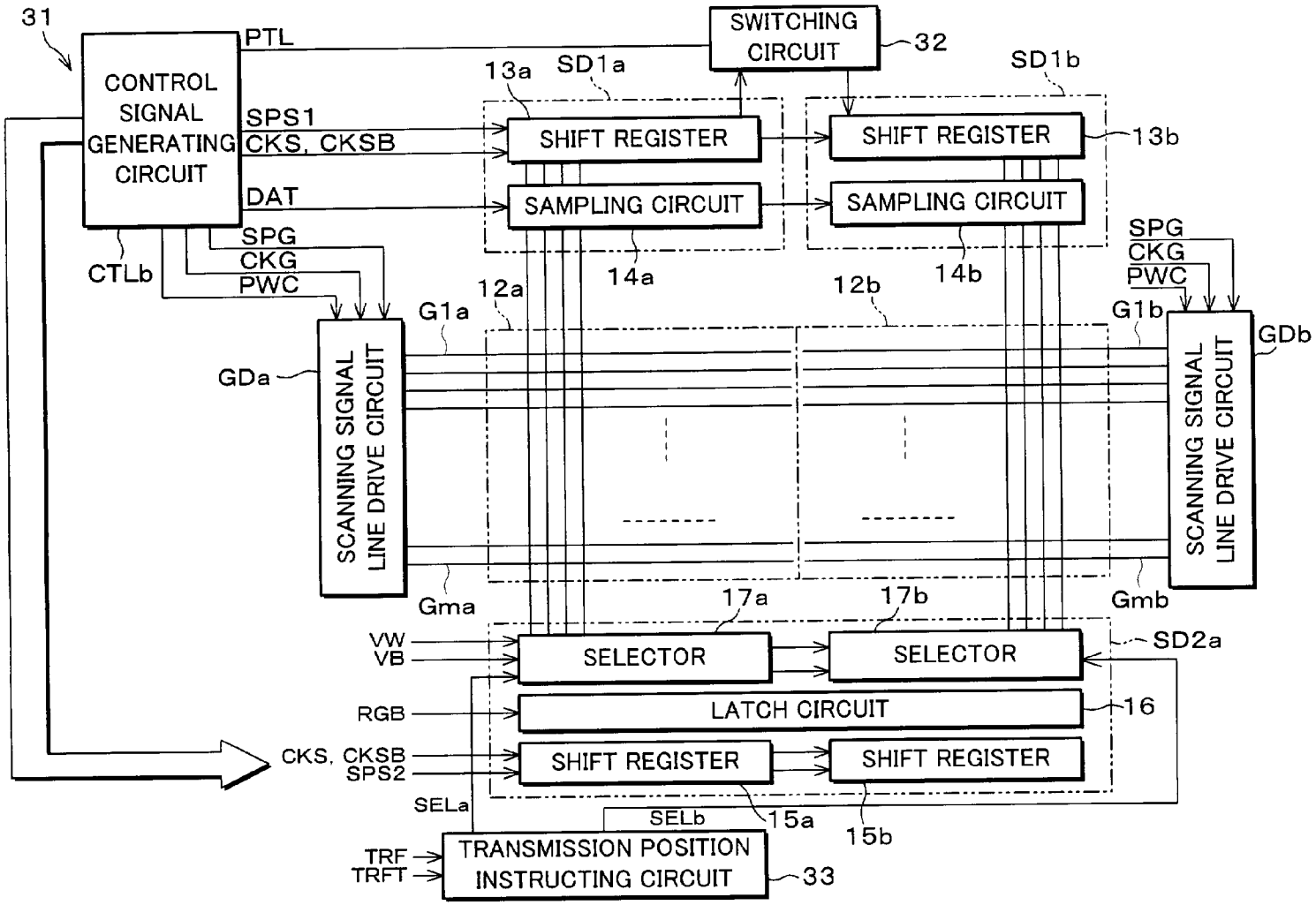
FIG. 14 is a block diagram, illustrating an electrical arrangement of a liquid crystal display device which is a display device in accordance with yet another embodiment of the present invention.

FIG. 14 is a block diagram, illustrating an electrical arrangement of a liquid crystal display device 31 which is a display device in accordance with yet another embodiment of the present invention. This liquid crystal display device 31 is similar to the foregoing liquid crystal display devices 11 and 21, and hence corresponding members are given the same numbers so that the descriptions are omitted for the sake of simplicity. This liquid crystal display device 31 is arranged in such a manner that the display section 12 is divided into display sections 12*a* and 12*b*, and corresponding to them, the data signal line drive circuit SD1 is also divided into scanning signal line drive circuits SD1*a* and SD1*b*. Also, the scanning signal line drive circuit GD is divided into two scanning signal line drive circuits GDa and GDb.

The scanning signal lines are divided at the border between the display sections 12*a* and 12*b*, such as lines G1*a*-Gma and lines G1*b*-Gmb in the figure. Thus, the display sections 12*a* and 12*b* can be driven individually as well as in sync with each other, by the respective data signal line drive circuits SD1*a* and SD1*b*.

The data signal line drive circuit SD1*a* is composed of a shift register 13*a* and a sampling circuit 14*a*, and the data signal line drive circuit SD1*b* is composed of a shift register 13*b* and a sampling circuit 14*b*. Between the shift registers 13*a* and 13*b*, a switching circuit 32 is provided. The switching circuit 32 determines whether or not a sampling pulse from the last stage of the shift register 13*a* is supplied to the first stage of the shift register 13*b*, responding to a pulse transfer signal PTL supplied from a control signal generating circuit CTLb.

In contrast, the data signal line drive circuit SD2*a* is provided with: two shift registers 15*a* and 15*b*; a latch circuit 16; and two selectors 17*a* and 17*b*. Responding to the outputs from the respective shift registers 15*a* and 15*b*, the latch circuit 16 serially latches the binary image signals RGB. Responding to the control signal TRF, the selectors 17*a* and 17*b* select either one of the liquid crystal applied voltages VB and VW in accordance with the output from the latch circuit 16, so as to output the selected voltage to the data signal lines S. Also, in association with this data signal line drive circuit SD2*a*, a transmission position instructing circuit 33 is provided. This transmission position instructing circuit 33 determines either the control signal TRF is supplied only to the selector 17*b* or the signal TRF is supplied to both of the selectors 17*a* and 17*b*.

Figure 15:
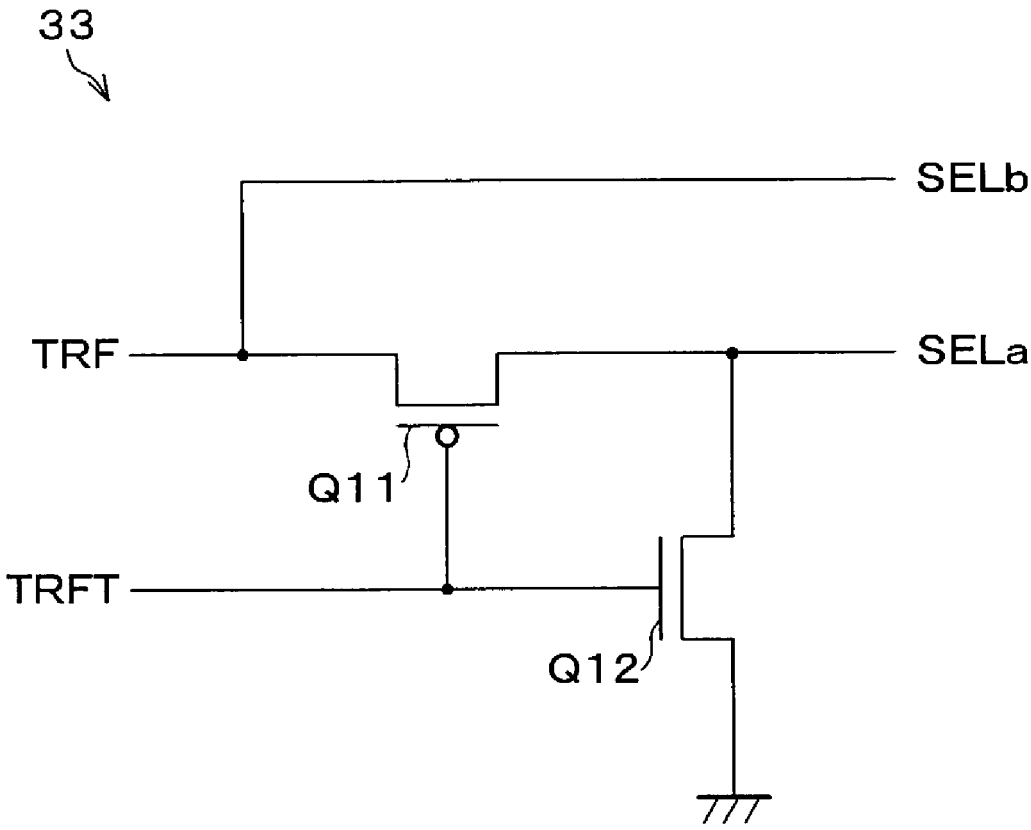
FIG. 15 is a circuit diagram, illustrating an arrangement of a transmission position instructing circuit of the liquid crystal display device of FIG. 14.

FIG. 15 illustrates an arrangement of the transmission position instructing circuit 33. As in the foregoing description, the control signal TRF is outputted as a select signal SELb for selecting the selector 17*b*, so as to be supplied to the source of an analog switch Q11 composed of a P-type FET. From the drain of the analog switch Q11, a select signal SELa for selecting the selector 17*a* is outputted, and the gate of the analog switch Q11 receives a transfer control signal TRFT from the control signal generating circuit CTLb. The drain of the analog switch Q11 is connected to the drain of a switch Q12 composed of an N-type FET, the source of the switch Q12 is grounded, and the gate of the switch Q12 receives the transfer control signal TRFT.

To the transmission position instructing circuit 33 with the foregoing arrangement, a transfer signal TRF which is high-active is supplied during a blank period in one horizontal period. On this occasion, if a transfer control signal TRFT which is low-active is in the low-level, the analog switch Q11 is turned on and the switch Q12 is turned off. On this occasion, the transfer signal TRF is supplied to both of the selectors 17*a* and 17*b*, as the select signals SELa and SELb. Thus, in both of the selectors 17*a* and 17*b*, either one of the liquid crystal applied voltages VB and VW is selected in accordance with the image signals RGB. The selected voltage is outputted to the data signal lines S at once.

When the transfer control signal TRFT is in the high-level, the analog switch Q11 is turned off and the switch Q12 is turned on. On this account, the select signal SELa is fixed at the inactive low-level, so that only the select signal SELb is outputted. Thus, only the selector 17*b* selects either one of the liquid crystal applied voltages VB and VW in accordance with the image signals RGB, and the selected voltage is supplied to the data signal lines S.

Figure 16:
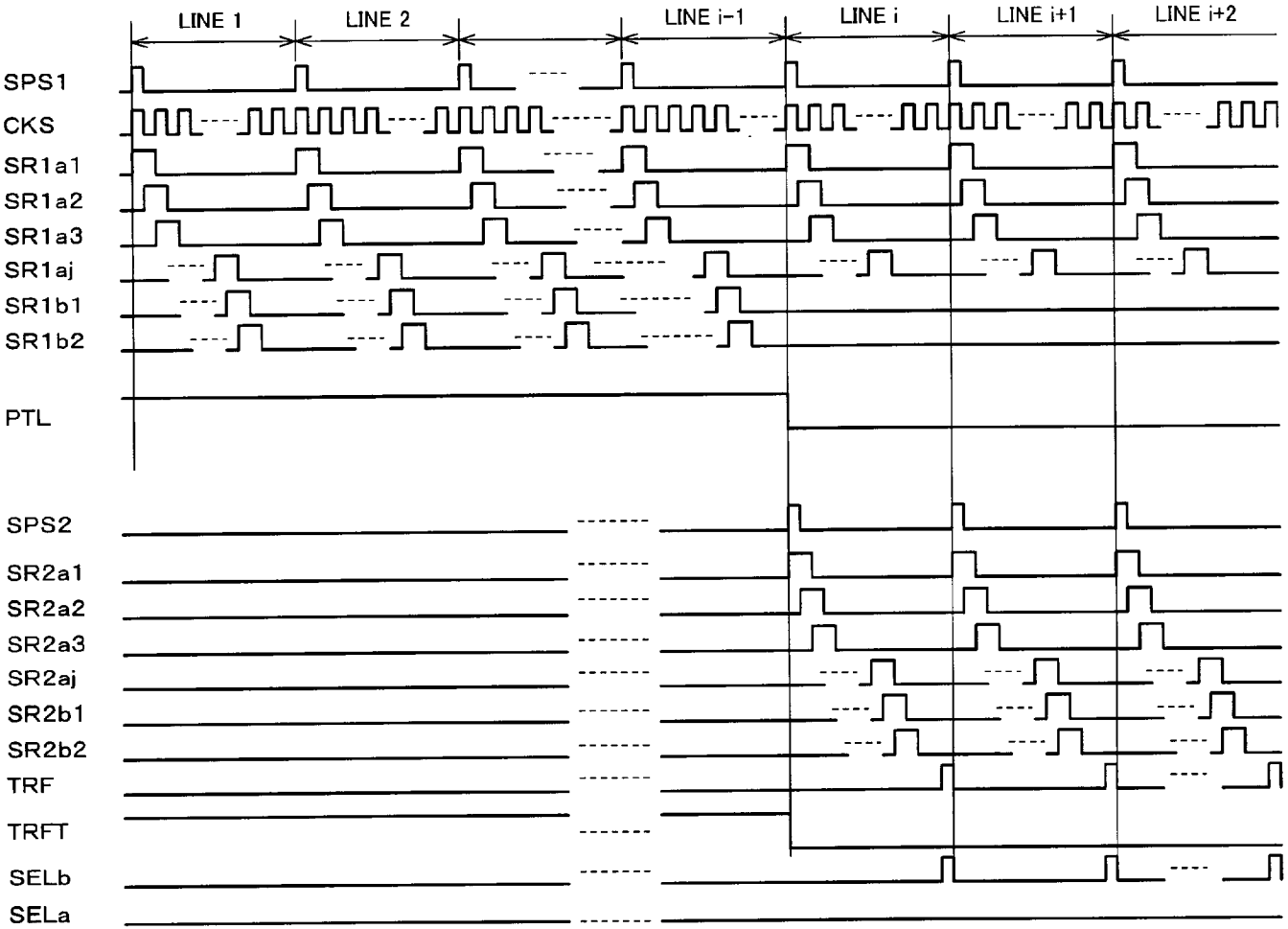
FIG. 16 illustrates waveform charts for describing an example of the drive of the liquid crystal display device of FIG. 14.

FIG. 16 illustrates waveform charts for describing an example of the drive of the liquid crystal display device 31 having the foregoing arrangement. In this figure, the states of respective cells of the shift register 13*a* in the data signal line drive circuit SD1*b* are indicated such as SR1*b*1 and SR1*b*2, the states of respective cells of the shift register 15*a* in the data signal line drive circuit SD2*a* are indicated as SR2*a*1-SD2*aj*, and the states of respective cells of the shift register 15*b* are indicated such as SR2*b*1 and SR2*b*2.

Moreover, the example illustrated in FIG. 16 shows an arrangement such that data signal lines S1 through Sj−1 carry out the control being independent from the control carried out by data signal lines Sj, Sj+1, and so on. That is to say, the display section 12*a* is driven by the data signal line S1 through Sj−1 and the display section 12*b* is driven by the data signal lines Sj-Sm. FIG. 16 also illustrates such an example that scanning signal lines G1 through Gi−1 carry out the control being independent from the control carried out by scanning signal lines Gi, Gi+1, and so on.

Until the line i−1, the pulse transfer signal PTL is active and in the high-level, and hence respective multiple gray-scale image signals DAT supplied from the data signal line drive circuits SD1*a* and SD1*b* are written into the respective display sections 12*a* and 12*b*. On this occasion, the data signal line drive circuit SD2*a* does not receive the data scanning start signal SPS2 and the transfer signal TRF, so that the data signal line drive circuit SD2*a* is stopped. In other words, the writing of the voltage VB or the voltage VW by the data signal line drive circuit SD2*a* is prohibited and this results in the reduction of the power consumption.

In contrast, from the line i, the pulse transfer signal PTL is caused to be inactive and in the low-level. Thus, it is prohibited to transfer the pulse from a cell SR1*aj*, which is the last stage of the shift register 13*a* in the data signal line drive circuit SD1*a*, to a cell SR1*b*1 which is the first stage of the shift register 13*b* in the data signal line drive circuit SD1*b*. In other words, the multiple gray-scale signals DAT supplied from the data signal line drive circuit SD1*a* is written into only the display section 12*a*, and the writing by the data signal line drive circuit SD1*b* is prohibited.

On this occasion, the data signal line drive circuit SD2*a* is receiving the data scanning start signal SPS2, and the transfer control signal TRFT is in the low-level. Thus, during a blank period when the transfer signal TRF is active and in the high-level, the voltage VB or the voltage VW is written only into the display section 12*b* by the data signal line drive circuit SD2*a*. In other words, from the line i, the data are written into the display sections 12*a* and 12*b* by the data signal line drive circuits SD1*a* and SD2*a*, respectively.

Figure 17:
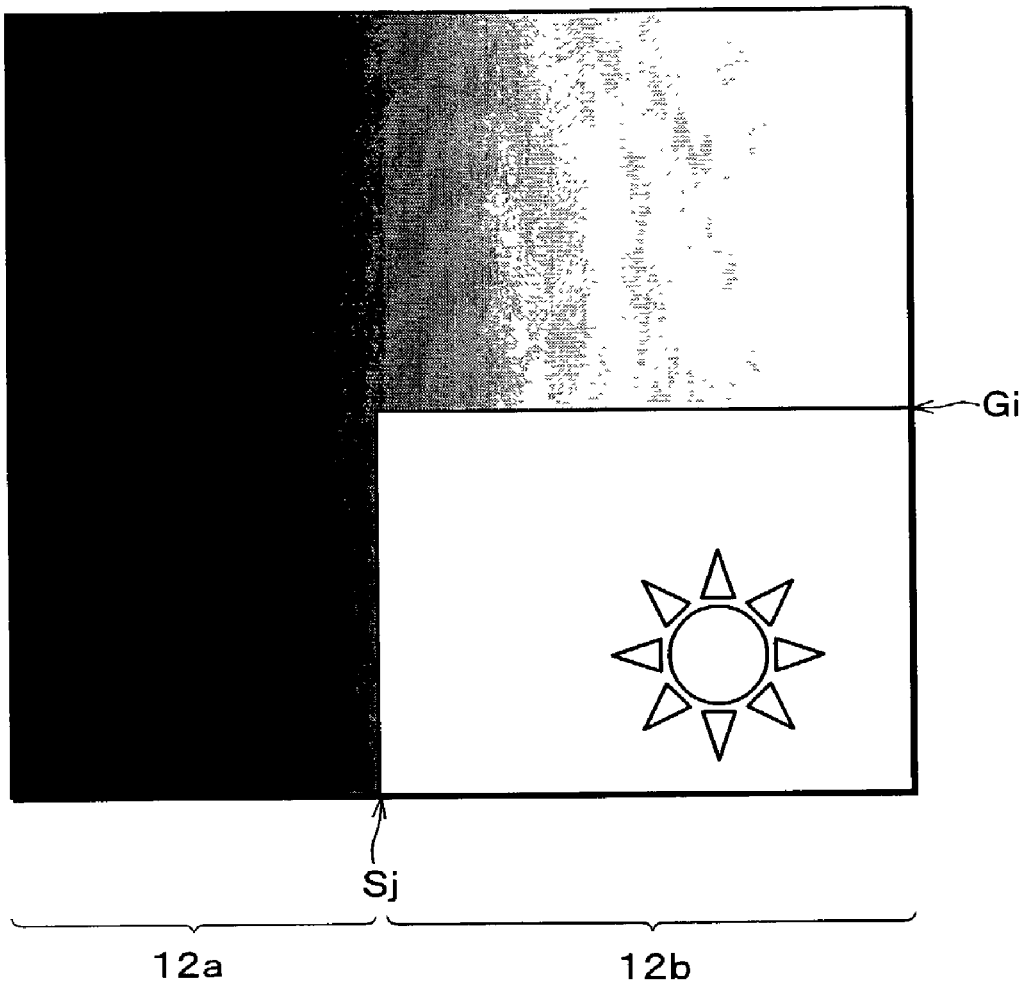
FIG. 17 illustrates an example of the displaying by the drive illustrated in FIG. 16.

FIG. 17 illustrates an example of the displaying when the drive shown in FIG. 16 is carried out. Displaying with multiple gray-scales is carried out on the whole display section 12*a* and a portion of the display section 12*b*, the portion corresponding to the lines until the line i−1, and binary displaying is carried out in a portion of the display section 12*b*, the portion corresponding to the line i and later. In this manner, it is possible to carry out the displaying in which the multiple gray-scale displaying and the binary displaying are complicatedly mixed. Thus, although not illustrated in FIG. 16, causing the refresh rate of the area of binary displaying to be lower than the refresh rate of the area of multiple gray-scale displaying makes it possible to reduce the power consumption as well as to prevent the degradation of the quality of displaying.

Figure 18:
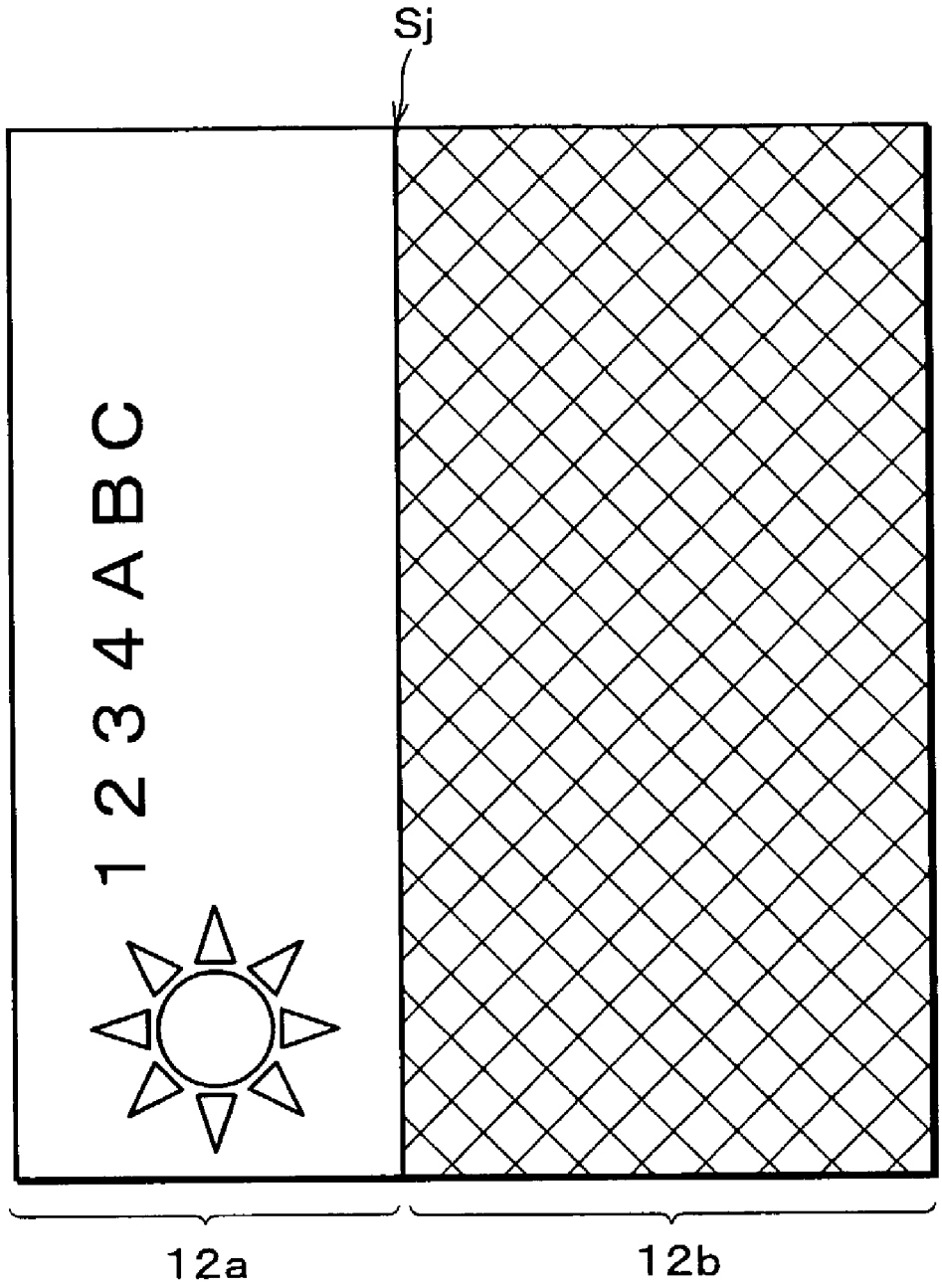
FIG. 18 illustrates another example of the displaying of the liquid crystal display device of FIG. 14.

FIG. 18 illustrates another example of displaying by the liquid crystal display device 31 with the foregoing arrangement. In this example, the display section 12*a* is a display section, while the display section 12*b* is a non-display section. The display section 12*a* is driven by either one of the data signal line drive circuit SD1*a* and the data signal line drive circuit SD2*a*, and the display section 12*b* is driven by the data signal line drive circuit SD2*a*. The refresh rate of the display section 12*b* is set so as to be lower than the refresh rate of the display section 12*a*. Also, since the voltage VB or the voltage VW is uniformly written, the display section 12*b* carries out uniform displaying with a color of black or white, which is considered as non-displaying and does not contain any significant information but can be used as a background image. Incidentally, also in the case of binary displaying by the display section 12*a*, as FIG. 10 illustrates, the refresh rate on the occasion of using the data signal line drive circuit SD1*a* must be higher than the refresh rate on the occasion of using the data signal line drive circuit SD2*a*, in order to keep the quality of displaying.

When the data signal line drive circuit SD1*a* is used, the pulse transfer signal PTL causes the data signal line drive circuit SD1*b* to be stopped. When neither of the data signal line drive circuits SD1*a* and SD1*b* is used, the supply of the data scanning start signal SPS1 is stopped so that both of the circuits are caused to be stopped. Moreover, in the data signal line drive circuit SD2*a*, the operation of the selector 17*a* can be stopped on account of the control signal TRF.

FIGS. 17 and 18 illustrate the examples of dividing the display section 12 into two areas. However, the present invention is not limited to these arrangements so that the display section may be divided into not less than three areas. Provided that there are three areas P1*e*, P2*e*, and P3*e* (these areas are not illustrated), the refresh rates of these areas may be different from each other, and the refresh rate of the area P1*e* may be identical with the refresh rate of the area P3*e*. Moreover, when the refresh rate of the area P1*e* is identical with that of the area P3*e*, the areas P1*e* and P3*e* have each different timings of the writing so that frames for the writing in the area P1*e* may be different from frames for the writing in the area P3*e*.

This also holds true with a case of dividing the display section into not less than four areas. Provided that there are four areas P1*f*, P2*f*, P3*f*, and P4*f* (these areas are not illustrated), these areas do not necessarily have each different refresh rate. For instance, the refresh rate of the area P1*f* and the area P4*f* is 1 Hz, the refresh rate of the area P2*f* is 10 Hz, and the refresh rate of the area P3*f* is 60 Hz. Moreover, the timings of the writing in the area P1*f* may be different from those in the area P4*f* so that the writings in these areas may be carried out in different frames.

There are such alternative examples that the refresh rate of the areas P1*f* and P3*f* is 10 Hz and the refresh rate of the areas P2*f* and P4*f* is 60 Hz, and the timings of the writing in the area P1*f* may be different from those in the area P3*f* so that the writing in these areas may be carried out in different frames, and timings of the writing in the area P2*f* may be different from those in the area P4*f* so that the writings in these areas may be carried out in different frames. It is noted that the present invention is not limited to these examples.

At any rate, it is possible to realize these arrangements on condition that the pulse transfer signal PTL supplied to the data signal line drive circuit SD1*a* of the liquid crystal display device illustrated in FIG. 14, the transfer control signal TRFT supplied to the data signal line drive circuit SD1*b*, and the pulse width control signal PWC supplied to the scanning signal line drive circuits GDa and GDb (or the frame control signal FRCTL supplied to the frame control circuit 22 illustrated in FIG. 11) are adjusted to be suitable for displaying by the respective arrangements.

FIG. 14 illustrates the data signal line drive circuit SD1 which is divided into two data signal line drive circuits. However, the present invention is not limited to this arrangement so that the data signal line drive circuit SD1 may be divided into not less than three data signal line drive circuits. In this case, at least two switching circuits 32 are provided and the pulse transfer signal PTL is supplied to both of the circuits 32.

Provided that (i) there are three data signal line drive circuits SD11*a*, SD11*b*, and SD11*c*, (ii) a pulse transfer signal supplied to a switching circuit provided between the data signal line drive circuits SD11*a* and SD11*b* is PTL1, and (iii) a pulse transfer signal supplied to a switching circuit provided between the data signal line drive circuits SD11*b* and SD11*c* is PTL2, when only the data signal line drive circuit SD11*a* is activated in a frame, both of the pulse transfer signals PTL1 and PTL2 are caused to be in the low-level, and when only the data signal line drive circuits SD11*a* and SD11*b* are activated, the pulse transfer signal PTL1 is caused to be in the high-level and the pulse transfer signal PTL2 is caused to be in the low-level.

When all of the data signal line drive circuits SD11*a*, SD11*b*, and SD11*c* are activated, both of the pulse transfer signals PTL1 and PTL2 are caused to be in the high-level. Moreover, provided that the shift register used in the data signal line drive circuit is a bi-directional shift register, it is possible to input the data scanning start signal SPS from the data signal line drive circuit SD11*c*, rather than from the data signal line drive circuit SD11*a*. In this case, in order to activate only the data signal line drive circuit SD11*c*, the pulse transfer signals PTL1 and PTL2 are caused to be in the low-level. When only the data signal line drive circuits SD11*b* and SD11*c* are activated, the pulse transfer signal PTL1 is caused to be in the low-level and the pulse transfer signal PTL2 is caused to be in the high-level. This also holds true with a data signal line drive circuit divided into not less than four data signal line drive circuits.

Moreover, although FIG. 14 illustrates two selectors as the selectors of the data signal line drive circuit SD2*a*, the present invention is not limited to this arrangement so that the data signal line drive circuit SD2*a* may be divided into not less than three selectors.

Further, in the present invention, it is not necessary to keep the refresh rate of each area of the display section constant, so that the refresh rate of an area may be varied. For instance, the multiple gray-scale display area P1*a* and the binary display area P2*a* of FIG. 9(*a*) are re-arranged so as to be a binary display area P1*a* and a multiple gray-scale display area P2*a*, after a lapse of a predetermined time, and in accordance with this re-arrangement, the refresh rates of the respective areas P1*a* and P2*a* are changed. This also holds true with other embodiments.

Moreover, although the foregoing embodiments are arranged in such a manner that the display area is divided in increments of the scanning signal lines or the data signal lines and the refresh rate is varied in accordance with the modes of displaying, it is possible to vary the refresh rate in increments of the pixels.

In the scanning signal line drive circuits 11, 21, and 31 in accordance with the present invention, it is preferable that the members such as the data signal line drive circuits SD1, SD1*a*, SD1*b*, SD2, and SD2*a*, the scanning signal line drive circuits GD, GD', GDa, and GDb, and the active element SW are made of active elements with high mobility such as a polycrystalline silicon thin-film transistor, and these members are formed on a single substrate. As in the foregoing description, the active elements with high mobility have a large leak current on the occasion of OFF-state, and hence the present invention can be adopted very effectively. Also, since the number of the signal lines extended from the substrate is constant even if the numbers of the data signal lines S and the scanning signal lines G are increased, it is unnecessary to newly provide a drive circuit, and thus the undesirable increase of capacities of the respective signal lines and the decrease of the packing density can be prevented.

Moreover, in the liquid crystal display device 11, 21, and 31, the data signal line drive circuits SD1, SD1*a*, SD1*b*, SD2, and SD2*a*, the scanning signal line drive circuits GD, GD', GDa, and GDb, and the pixel circuits include active elements which are fabricated at a process temperature not more than 600° C. When the process temperature of the active elements is not more than 600° C., conventional glass substrates (glass substrates whose distortion point is not more than 600° C.) can be adopted without causing the warpage or bending due to the process which is carried out at a temperature not less than a distortion point, so that it is possible to realize a liquid crystal display device which is easily mounted and has a large display area.

Incidentally, Japanese Laid-Open Patent Application No. 5-188885/1993 (Tokukaihei 5-188885; published on Jul. 30, 1993) discloses that, on occasions when an image with lines fewer than the number of lines of a display section is displayed, a non-display area is scanned in an interlace manner so that non-display data is written in order to scan a non-display area within a limited period of time, in a case such that a display section whose aspect ratio is 4:3 displays an image of 16:9. However, in this conventional art, always either one of the odd-numbered lines or one of the even-numbered lines is scanned in the scanning period of the non-display area, and hence this arrangement is totally different from the liquid crystal display device 11 in accordance with the present invention, in which device the non-display area is intermittently scanned.

Moreover, although the liquid crystal display device 11 is provided with two data signal line drive circuits SD1 and SD2 for writing multiple gray-scale data and binary data, respectively, it is possible to realize the partial drive using either one of these data signal line drive circuits.

As described above, the driving method of the display device in accordance with the present invention, the display device being provided with a display section which is composed of a plurality of pixels each including an active element, comprises the steps of: setting at least two refresh rates of the pixels; dividing the display section into a plurality of areas; and writing data into the pixels in the plurality of areas at any one of the at least two refresh rates.

Thus, data is written into the pixels in the plurality of areas constituting the display section, at any one of not less than two refresh rates. For instance, when displaying a flashing colon (:) for briefly counting seconds in a clock on the screen, an area including the image of the clock is produced by means of the division of the display section and only the flashing portion of the area is rewritten, so that the area is rewritten in each second, i.e. at a refresh rate of 1 Hz, and areas other than this area are rewritten at 60 Hz like a television picture. Moreover, the refresh rates of respective display areas are arranged so as to be different from each other. For instance, when a static image is displayed in an area other than the foregoing area, the refresh rate of this area is set to be 15 Hz.

As described above, if the pixels permit to freely arrange the length of refresh periods, it is possible to divide the display section into a plurality of areas according to transfer rates of the data and refresh rates, so as to arrange various refresh rates of displaying. In other words, unnecessary refreshing is eliminated and each area is arranged so as to have a different refresh rate, i.e. frame rates are arranged so as to be different from each other, so that the power consumption can be reduced.

As a result, it is possible to provide a driving method of a display device which exhibits lower power consumption and better quality of displaying, on the occasion of carrying out displaying with a plurality of modes such as displaying and non-displaying, on a display section using an active element.

Moreover, the driving method of the display device in accordance with the present invention is arranged in such a manner that: the plurality of areas are composed of a display area and a non-display area; data is written into pixels in the display area either in each frame or intermittently; and data is intermittently written into pixels in the non-display area at a refresh rate lower than a refresh rate for writing the data into the pixels in the display area.

Thus, when carrying out partial drive of display devices such as a TFT active matrix display device, data is written into the pixels in the display area either in each frame or intermittently. In contrast, data is written into the pixels in a non-display area at a refresh rate lower than a refresh rate for writing the data into the pixels in the display area. That is to say, the data (voltage or current) for non-displaying is written not only in the first frame but also either regularly or in an arbitrary frame. On this account, the non-display area is refreshed at regular or arbitrary intervals which are longer than those in the display area.

For this reason, even if the mobility of the active element is high and a leak current on the occasion of OFF-state is large, or even if the amount of an accumulated electric charge due to the photoelectric effect is large, it is possible to prevent unnecessary displaying on the display area, which is caused because the writing into the pixels in the display area influences on the pixels in the non-display area. Moreover, the data signal line drive circuit is completely stopped so that data signal lines each having a large capacity are not charged when the writing is not carried out during the period of scanning the non-display area. Thus, it is possible to improve the quality of partial displaying, while restraining the power consumption.

As a result, it is possible to provide a driving method of a display device which exhibits lower power consumption and better quality of displaying, on the occasion of carrying out partial drive by a display section using an active element.

Moreover, the driving method of the display device in accordance with the present invention is arranged in such a manner that an interval of intermittent writing of the data into the pixels in the non-display area is determined in accordance with at least one factor selected from the group consisting of a mode of displaying, a type of the active element, a size of the active element, a driving method of an opposed electrode, liquid crystal materials, an auxiliary capacitor, a content of displaying on the display area, and a size of the display area.

Thus, the intervals of the intermittent writing into the pixels in the non-display area, i.e. the refresh rates are determined in accordance with at least one factor selected from the group consisting of: a mode of displaying, which is determined whether or not a backlight is used; the type of the active element such as crystal grains in the form of amorphous, microcrystalline and polycrystalline, etc.; the size of the active element, gauged by a channel length L, a channel width W, etc.; the driving method of an opposed electrode; liquid crystal materials; an auxiliary capacitor; the content of displaying on the display area; and the size of the display area. On this account, the refresh rates can be determined to be the lowest frequency, on condition that the quality of the displaying is not deteriorated.

Moreover, the driving method of the display device in accordance with the present invention is arranged in such a manner that the data is intermittently written into the pixels in the non-display area, with both polarities, so that a difference between (i) an effective value of a voltage of one polarity and (ii) an effective value of a voltage of the other polarity is set to be not more than a predetermined value, during a period of applying the voltages to the pixels.

Thus, the data is intermittently written into the pixels in the non-display area, with both polarities, so that the difference between (i) the effective value of a voltage of one polarity and (ii) the effective value of a voltage of the other polarity is set to be not more than a predetermined value, during the period of applying the voltages to the pixels, so that it is possible to carry out the intermittent writing without the unbalance of polarities, by setting the predetermined value to be small. With this arrangement, even if the refresh rate on the occasion of writing is low, the drive of the pixels with the reversal of polarities can be carried out in order to restrain the degradation of the liquid crystal materials, and this drive can be carried out without causing the flicker.

Moreover, the driving method of the display device in accordance with the present invention is arranged in such a manner that the polarities on occasion of writing the data into the pixels in the non-display area are set so as to correspond to polarities of previous writings.

Thus, the polarities on the occasion of writing the data into the pixels in the non-display area are set so as to correspond to the polarities of previous writings so that the difference between effective values of the respective voltages with either of the polarities is arranged so as to be surely not more than a predetermined value.

Moreover, the driving method of the display device in accordance with the present invention is arranged in such a manner that the polarities on occasion of writing the data into the pixels in the non-display area are automatically adjusted in accordance with polarities of previous writings.

Since the polarities on occasion of writing the data into the pixels in the non-display area are automatically adjusted in accordance with polarities of previous writings, the difference between effective values of the respective voltages with either of the polarities is arranged so as to be surely not more than a predetermined value. Further, if the polarities of the writings are stored using a memory in advance, a certain amount of memory capacity corresponding to the number of the types of the refresh rates is required. However, the method of automatically adjusting the frequencies of the writing only requires the judgment of polarities according to the polarities of the previous writings so as not to require the memory capacity corresponding to the number of the types of the refresh rates, and hence this method can easily accommodate to various types of refresh rates.

Further, the driving method of the display device in accordance with the present invention is arranged in such a manner that the plurality of areas are two display areas, and data is written into pixels in one display area either in each frame or intermittently, while data is intermittently written into pixels in the other display area at a refresh rate lower than a refresh rate for writing the data into the pixels in one display area.

Thus, in display devices such as a TFT active matrix display device, data is written into pixels of one display area either in each frame or intermittently. In contrast, into pixels of the other display area, data is intermittently written at a refresh rate lower than the refresh rate of the writing into one display area. For this reason, the other display area is refreshed at intervals longer than those of one display area.

As a result, the writings into the respective display areas are carried out at each different refresh rate, and hence it is possible to prevent the generation of unnecessary displaying on the other display area, which is caused because the writing into one display area influences on the pixels of the other display area. Moreover, the data signal line drive circuit is completely stopped so that data signal lines each having a large capacity are not charged, when the writing is not carried out during the period of scanning the other display area. Thus, it is possible to improve the quality of displaying, while restraining the power consumption.

Moreover, the driving method of the display device in accordance with the present invention is arranged in such a manner that an interval of intermittent writing of the data into the pixels in the other display area is determined in accordance with at least one factor selected from the group consisting of a mode of displaying, a type of the active element, a size of the active element, a driving method of an opposed electrode, liquid crystal materials, an auxiliary capacitor, a content of displaying on one display area, and a size of one display area.

Thus, the intervals of the intermittent writing into the pixels in the other display area, i.e. the refresh rates are determined in accordance with at least one factor selected from the group consisting of: a mode of displaying, which is determined whether or not a backlight is used; the type of the active element such as crystal grains in the form of amorphous, microcrystalline and polycrystalline, etc.; the size of the active element, gauged by a channel length L, a channel width W, etc.; the driving method of an opposed electrode; liquid crystal materials; an auxiliary capacitor; the content of displaying on one display area; and the size of one display area. On this account, the refresh rates can be determined to be the lowest frequency, on condition that the quality of the displaying is not deteriorated.

Moreover, the driving method of the display device in accordance with the present invention is arranged in such a manner that the data is intermittently written into the pixels in the other display area, with both polarities, so that a difference between (i) an effective value of a voltage of one polarity and (ii) an effective value of a voltage of the other polarity is set to be not more than a predetermined value, during a period of applying the voltages to the pixels.

The pixels of the other display area is subjected to the intermittent writing with both polarities and the difference between (i) the effective value of the voltage of one polarity and (ii) the effective value of the voltage of the other polarity is set to be not more than a predetermined value, during a period of applying the voltages to the pixels. Thus, setting the predetermined value to be small makes it possible to carry out the intermittent writing without the unbalance of the polarities. For this reason, even if the refresh rate on the occasion of writing is low, the drive of the pixels with the reversal of polarities can be carried out in order to restrain the degradation of the liquid crystal materials, and this drive can be carried out without causing the flicker.

Moreover, the driving method of the display device in accordance with the present invention is arranged in such a manner that the polarities on occasion of writing the data into the pixels in the other area is set so as to correspond to polarities of previous writings.

Since the polarities on occasion of writing the data into the pixels in the other area is set so as to correspond to polarities of previous writings, the difference between effective values of the respective voltages with either of the polarities is arranged so as to be surely not more than a predetermined value.

Further, the driving method of the display device in accordance with the present invention is arranged in such a manner that the polarities on occasion of writing the data into the pixels in the other display area are automatically adjusted in accordance with polarities of previous writings.

Thus, since the polarities on occasion of writing the data into the pixels in the other area are automatically adjusted in accordance with polarities of previous writings, the difference between effective values of the respective voltages with either of the polarities is arranged so as to be surely not more than a predetermined value. Further, if the polarities of the writings are stored using a memory in advance, a certain amount of memory capacity corresponding to the number of the types of the refresh rates is required. However, the method of automatically adjusting the frequencies of the writing only requires the judgment of polarities according to the polarities of the previous writings so as not to require the memory capacity corresponding to the number of the types of the refresh rates, and hence this method can easily accommodate to various types of refresh rates.

Moreover, the driving method of the display device in accordance with the present invention is arranged in such a manner that the plurality of areas are not less than three areas, and data is written into the not less than three areas at each different refresh rate.

Thus, since the writings into the not less than three areas are carried out at each different refresh rate, it is possible to prevent the generation of unnecessary displaying, which is caused because the writing into one display area influences on the pixels of another display area. Moreover, the data signal line drive circuit is completely stopped so that data signal lines each having a large capacity are not charged, when the writing is not carried out during the period of scanning the other display area. For this reason, it is possible to improve the quality of displaying, while restraining the power consumption.

Moreover, the driving method of the display device in accordance with the present invention is arranged in such a manner that data is intermittently written into the pixels in at least one of the not less than three areas, with both polarities, so that a difference between (i) an effective value of a voltage of one polarity and (ii) an effective value of a voltage of the other polarity is set to be not more than a predetermined value, during a period of applying the voltages to the pixels.

Thus, since data is intermittently written into pixels in an area, with both polarities, and the difference between (i) the effective value of a voltage of one polarity and (ii) the effective value of a voltage of the other polarity is set to be not more than a predetermined value, during a period of applying the voltages to the pixels, it is possible to carry out the intermittent writing without the unbalance of the polarities, by, for instance, setting the predetermined value to be small. For this reason, even if the refresh rate on the occasion of writing is low, the drive of the pixels with the reversal of polarities can be carried out in order to restrain the degradation of the liquid crystal materials, and this drive can be carried out without causing the flicker.

Moreover, the driving method of the display device in accordance with the present invention is arranged in such a manner that the polarities on occasion of writing the data into the pixels in the at least one area are set so as to correspond to polarities of previous writings.

Thus, since the polarities on occasion of writing the data into the pixels in the at least one area are set so as to correspond to polarities of previous writings, the difference between effective values of the respective voltages with either of the polarities is arranged so as to be surely not more than a predetermined value.

Moreover, the driving method of the display device in accordance with the present invention is arranged in such a manner that the polarities on occasion of writing the data into the pixels in the at least one area are automatically adjusted in accordance with polarities of previous writings.

Thus, since the polarities on occasion of writing the data into the pixels in the at least one area are automatically adjusted in accordance with polarities of previous writings, the difference between effective values of the respective voltages with either of the polarities is arranged so as to be surely not more than a predetermined value. Further, if the polarities of the writings are stored using a memory in advance, a certain amount of memory capacity corresponding to the number of the types of the refresh rates is required. However, the method of automatically adjusting the frequencies of the writing only requires the judgment of polarities according to the polarities of the previous writings so as not to require the memory capacity corresponding to the number of the types of the refresh rates, and hence this method can easily accommodate to various types of refresh rates.

Moreover, the display device in accordance with the present invention is an active matrix display device, comprising a control signal generating circuit for controlling writing of data into pixels of a display section, by driving a data signal line drive circuit and a scanning line drive circuit, wherein: the writing of the data into the pixels can be controlled by not less than two refresh rates; the display section is divided into a plurality of areas; and the data is written into the pixels in the plurality of areas at the not less than two refresh rates.

Thus, since the data is written into the pixels in the plurality of areas constituting the display section, at any one of not less than two refresh rates, it is possible to provide a display device which exhibits lower power consumption and better quality of displaying, on the occasion of carrying out displaying with a plurality of modes such as displaying and non-displaying on a display section using an active element.

Moreover, the display device in accordance with the present invention is arranged in such a manner that the control signal generating circuit divides the plurality of areas into a display area and a non-display area, causes data to be written into pixels in the display area in each frame, and causes data for non-displaying to be intermittently written into pixels in the non-display area.

Thus, when carrying out partial drive of display devices such as a TFT active matrix display device, data is written into the pixels in an display area either in each frame or intermittently. In contrast, data is written into the pixels in a non-display area at a refresh rate lower than a refresh rate for writing the data into the pixels in the display area. That is to say, the data (voltage and current) for non-displaying is written not only in the first frame but also either regularly or in an arbitrary frame. On this account, it is possible to provide a display device with improved quality of displaying and lower power consumption.

Moreover, the display device in accordance with the present invention is arranged in such a manner that an interval of intermittent writing into the pixels in the non-display area is determined in accordance with at least one factor selected from the group consisting of a mode of displaying, a type of an active element, a size of the active element, a driving method of an opposed electrode, liquid crystal materials, an auxiliary capacitor, a content of displaying on the partial display area, and a size of the partial display area.

Thus, the refresh rates can be determined to be the lowest frequency, on condition that the quality of the displaying is not deteriorated.

Moreover, the display device in accordance with the present invention is arranged in such a manner that the data is intermittently written into the pixels in the non-display area, with both polarities, so that a difference between (i) an effective value of a voltage of one polarity and (ii) an effective value of a voltage of the other polarity is set to be not more than a predetermined value, during a period of applying the voltages to the pixels.

Thus, even if the refresh rate on the occasion of writing is low, the drive of the pixels with the reversal of polarities can be carried out in order to restrain the degradation of the liquid crystal materials, and this drive can be carried out without causing the flicker.

Moreover, the display device in accordance with the present invention is arranged in such a manner that the polarities on occasion of writing the data into the pixels in the non-display area is set so as to correspond to polarities of previous writings.

Thus, since the polarities on occasion of writing data into pixels in an area is set so as to correspond to the polarities of previous writings, the difference between effective values of the respective voltages with either of the polarities is arranged so as to be surely not more than a predetermined value.

Moreover, the display device in accordance with the present invention is arranged in such a manner that the polarities on occasion of writing the data into the pixels in the non-display area is automatically adjusted in accordance with polarities of previous writings.

Thus, since the polarities on occasion of writing data into pixels in an area are automatically adjusted in accordance with the polarities of previous writings, the difference between effective values of the respective voltages with either of the polarities is arranged so as to be surely not more than a predetermined value. Further, since the memory corresponding to the types of the refresh rates is unnecessary, the display device can easily accommodate to various types of refresh rates.

Moreover, the display device in accordance with the present invention is arranged in such a manner that the control signal generating circuit divides the plurality of areas into two display areas, causes data to be written into pixels in one of two display areas in each frame, and causes data to be intermittently written into pixels in the other of two display areas.

Thus, since the writings into these two areas are carried out at each different refresh rate, it is possible to prevent the generation of unnecessary displaying, which is caused because the writing into one display area influences on the pixels of another display area. In addition, it is possible to improve the quality of displaying, while restraining the power consumption.

Moreover, the display device in accordance with the present invention is characterized in such a manner that an interval of intermittent writing into the pixels in the other of two display areas is determined in accordance with at least one factor selected from the group consisting of a mode of displaying, a type of an active element, a size of the active element, a driving method of an opposed electrode, liquid crystal materials, an auxiliary capacitor, a content of displaying on one of two display areas, and a size of one of two display areas.

Thus, the refresh rates can be determined to be the lowest frequency, on condition that the quality of the displaying is not deteriorated.

Moreover, the display device in accordance with the present invention is arranged in such a manner that the data is intermittently written into the pixels in the other of two display areas, with both polarities, so that a difference between (i) an effective value of a voltage of one polarity and (ii) an effective value of a voltage of the other polarity is set to be not more than a predetermined value, during a period of applying the voltages to the pixels.

Thus, even if the refresh rate on the occasion of writing is low, the drive of the pixels with the reversal of polarities can be carried out in order to restrain the degradation of the liquid crystal materials, and this drive can be carried out without causing the flicker.

Moreover, the display device in accordance with the present invention further comprises polarity setting means for setting the polarities on occasion of writing the data into the pixels in the other of two display areas to correspond to polarities of previous writings.

Thus, since the polarities on occasion of writing data into pixels in a display area is set so as to correspond to polarities of previous writings, the difference between effective values of the respective voltages with either of the polarities is arranged so as to be surely not more than a predetermined value.

Moreover, the display device in accordance with the present invention further comprises polarity self-adjustment means for automatically adjusting the polarities on occasion of writing the data into the pixels in the other of two display areas, in accordance with polarities of previous writings.

Thus, since the polarities on occasion of writing the data into pixels in an area are automatically adjusted in accordance with polarities of previous writings, the difference between effective values of the respective voltages with either of the polarities is arranged so as to be surely not more than a predetermined value. Further, since the memory corresponding to the types of the refresh rates is unnecessary, the display device can easily accommodate to various types of refresh rates.

Moreover, the display device in accordance with the present invention is arranged in such a manner that the control signal generating circuit divides the plurality of areas into not less than three display areas and causes data to be written into pixels in the not less than three display areas at each different refresh rates.

With this arrangement, since the writings into the not less than three areas are carried out at each different refresh rate, it is possible to prevent the generation of unnecessary displaying, which is caused because the writing into one display area influences on the pixels of other display areas. In addition, it is possible to improve the quality of displaying, while restraining the power consumption.

The display device in accordance with the present invention is arranged in such a manner that data is intermittently written into pixels in one of the not less than three areas, with both polarities, so that the difference between (i) an effective value of a voltage of one polarity and (ii) an effective value of a voltage of the other polarity is set to be not more than a predetermined value, during a period of applying the voltages to the pixels.

Thus, even if the refresh rate on the occasion of writing is low, the drive of the pixels with the reversal of polarities can be carried out in order to restrain the degradation of the liquid crystal materials, and this drive can be carried out without causing the flicker.

Moreover, the display device in accordance with the present invention further comprises polarity setting means for setting the polarities of writing the data into the one of the not less than three areas to correspond to polarities of previous writings.

Thus, since the polarities on occasion of writing data into pixels in a display area is set so as to correspond to polarities of previous writings, the difference between effective values of the respective voltages with either of the polarities is arranged so as to be surely not more than a predetermined value.

Further, the display device in accordance with the present invention further comprises polarity self-adjustment means for automatically adjusting the polarities on occasion of writing the data into the one of the not less than three areas, in accordance with polarities of previous writings.

Thus, since the polarities on occasion of writing the data into pixels in an area are automatically adjusted in accordance with polarities of previous writings, the difference between effective values of the respective voltages with either of the polarities is arranged so as to be surely not more than a predetermined value. Further, since the memory corresponding to the types of the refresh rates is unnecessary, the display device can easily accommodate to various types of refresh rates.

Moreover, the display device in accordance with the present invention is arranged in such a manner that the data signal line drive circuit is composed of a multiple gray-scale driver which writes data into pixels in at least one area and a binary driver which writes data into pixels in a plurality of areas other than the at least one area, and the control signal generating circuit selectively drives either one of the multiple gray-scale driver and the binary driver.

Thus, for instance, when a signal is supplied from the outside to the multiple gray-scale driver so that multiple gray-scale displaying is carried out and the signal is supplied to the binary driver so that binary displaying is carried out, a liquid crystal applied voltage inputted to the multiple gray-scale driver is an analog signal supplied from the outside, and hence, depending on the frequency of the analog signal, it is required to provide a high-performance analog amplifier in the control signal generating circuit. In contrast, depending on driving methods of a DC voltage or an AC voltage of liquid crystal, which is additionally supplied from the outside, the binary driver stores a digital (binary) signal which is supplied from the outside and selects a liquid crystal applied voltage with very low frequency in accordance with the stored digital data, such as 1H reversal drive, so that the control signal generating circuit does not require the high-performance analog amplifier for outputting the liquid crystal applied voltage, and only the DC voltage is required to be outputted.

While high-performance analog amplifiers consume a large amount of electric power, the costs of manufacturing the display device hardly increase, when aforementioned two drivers are formed on a single glass substrate along with the scanning signal line drive circuit and the pixels. On this account, mounting these two drivers and using them in a selective manner make it possible to reduce the opportunities of using the high-performance analog amplifier, so that the reduction of the power consumption can be realized.

The display device in accordance with the present invention is arranged in such a manner that the multiple gray-scale driver is composed of a plurality of drivers, the display device further comprising a switching circuit for transferring a transferred pulse from a last stage of a shift register in a first side of the multiple gray-scale driver to a first stage of a shift register in a second side of the multiple gray-scale driver, wherein the control signal generating circuit instructs the switching circuit to permit or prohibit transfer of the transferred pulse.

With this arrangement, when the switching circuit permits to transfer the transferred pulse from the last stage of the shift register in the first side to the first stage of the shift register in the side of the second side, it is possible to write data into the areas corresponding to both of the drivers at a high refresh rate, by the multiple gray-scale driver, and when the switching circuit prohibits to transfer the transferred pulse from the last stage of the shift register in the first side to the first stage of the shift register in the second side, it is possible to write data into an area corresponding to an area corresponding to the driver of the first side by the multiple gray-scale drive, and write data into an area corresponding to the driver of the second stage at a low refresh rate, by the binary driver. For This reason, it is possible to carry out the displaying in which the multiple gray-scale displaying and the binary displaying are complicatedly mixed.

Further, the display device in accordance with the present invention is arranged in such a manner that the binary driver includes: a shift register; a latch circuit which latches binary image signals, responding to an output pulse supplied from the shift register; and a plurality of selectors which select a voltage applied to liquid crystal, in accordance with an output from the latch circuit, the display device further comprising a transmission position instructing circuit for causing each of said plurality of selectors to be either active or inactive, wherein the control signal generating circuit instructs the transmission position instructing circuit to cause said plurality of selectors to be either active or inactive.

With this arrangement, since the selector which is caused to be active by the transmission position instructing circuit selects a liquid crystal applied voltage in accordance with the output from the latch circuit, it is possible to carry out the binary displaying by selecting areas by the binary driver. For this reason, it is possible to carry out the displaying in which the multiple gray-scale displaying and the binary displaying are complicatedly mixed.

Moreover, the display device in accordance with the present invention is arranged in such a manner that the scanning signal line drive circuit includes m-stages of shift registers and m first logic circuits, each of m first logic circuits receives a pulse from a corresponding stage of m-stages of shift registers and a pulse width control signal for permitting or prohibiting an output of the pulse, and the control signal generating circuit controls the pulse width of the pulse width control signal.

On this account, when m first logic circuits are permitted to output pulses which are supplied from respective m-stages of the shift registers, by the pulse width control signal whose pulse width is controlled by the control signal generating circuit, it is possible to supply active scanning signals from these first logic circuits so as to carry out the writing. In contrast, when the first logic circuits are prohibited to output the pulses, it is possible to set the scanning signals to be inactive so as not to carry out the writing.

Moreover, the display device in accordance with the present invention is arranged in such a manner that the scanning signal line drive circuit further includes m second logic circuits provided between m-stages of shift registers and m first logic circuits, and each of m second logic circuits generates the pulse supplied from a corresponding stage of m-stages of shift registers, by means of an input pulse and an output pulse supplied from the corresponding stage of m-stages of shift registers.

Thus, it is possible to generate the pulse supplied from the corresponding stage of m-stages of shift registers, by means of the input pulse and the output pulse supplied from the corresponding stage of m-stages of the shift registers.

Further, the display device in accordance with the present invention is arranged in such a manner that the scanning signal line drive circuit includes a plurality of drivers, the display device further comprising a frame control circuit for transferring a transferred pulse from a last stage of a shift register in a first side of the plurality of drivers to a first stage of the shift register in a second side of the plurality of drivers, wherein the control signal generating circuit instructs the frame control circuit to permit or prohibit transfer of the transferred pulse.

Thus, when the frame control circuit permits to transfer the transferred pulse from the last stage of the shift register in the first side to the first stage of the shift register in the second side, it is possible to write data into the areas corresponding to both of the drivers at a high refresh rate, and when the frame control circuit prohibits to transfer the transferred pulse, data can be written into (i) the area corresponding to the driver of the first stage at a high refresh rate and (ii) the area corresponding to the driver of the second stage at a low refresh rate.

Further, the display device in accordance with the present invention is arranged in such a manner that an active element is composed of a polycrystalline silicon thin-film transistor.

For this reason, the polycrystalline silicon thin-film transistor has high mobility and low OFF-resistance so that a leak current on the occasion of the OFF-state is large, and hence the present invention can be adopted very effectively.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An active matrix display device, comprising a control signal generating circuit for controlling writing of data into pixels of a display section, by driving a data signal line drive circuit and a scanning signal line drive circuit, wherein:

the writing of the data into the pixels can be controlled by not less than two refresh rates;

the display section is divided into a plurality of areas;

the data is written into the pixels in the plurality of areas at said not less than two refresh rates;

the scanning signal line drive circuit includes m-stages of shift registers and m first logic circuits, each of said m first logic circuits receives a pulse from a corresponding stage of said m-stages of shift registers and a pulse width control signal for permitting or prohibiting an output of the pulse, and the control signal generating circuit controls a pulse width of the pulse width control signal; and the scanning signal line drive circuit further includes m second logic circuits provided between said m-stages of shift registers and said m first logic circuits, and each of said m second logic circuits generates the pulse supplied from a corresponding stage of said m-stages of shift registers, by means of an input pulse and an output pulse supplied from the corresponding stage of said m-stages of shift registers.

2. An active matrix display device, comprising a control signal generating circuit for controlling writing of data into pixels of a display section, by driving a data signal line drive circuit and a scanning signal line drive circuit, wherein:

the writing of the data into the pixels can be controlled by not less than two refresh rates;

the display section is divided into a plurality of areas;

the data is written into the pixels in the plurality of areas at said not less than two refresh rates;

the scanning signal line drive circuit includes a plurality of drivers; and the display device further comprises a fame control circuit for transferring a transferred pulse from a last stage of e shift register in a first side of said plurality of drivers to a first stage of the shift register in a second side of said plurality of drivers; and the control signal generating circuit instructs the frame control circuit to permit or prohibit transfer of the transferred pulse.

3. A display device comprising:

scanning signal lines;

data signal lines arranged to cross the scanning signal lines;

pixels arranged in the vicinities of the crossings of the scanning signal lines and the data signal lines;

first and second data signal line drivers connected to the data signal lines; and a control signal generating circuit for controlling the writing of data into the pixels so that data is written into first ones of the pixels through the data signal lines by the first data signal line driver at a first refresh rate and data is written into second, different ones of the pixels through the data signal lines by the second data signal line driver at a second, different refresh rate, wherein while one of the first and second signal line drivers is writing data, the other one of the first and second signal line drivers is stopped; and wherein the first data signal line driver is connected to one end of the data signal lines and the second data signal line driver is connected to the other end of the data signal lines.

4. The display device as defined in claim 3, wherein the first data signal line driver writes multiple gray scale data into the first ones of the pixels and the second data signal line driver writes binary data into the second ones of the pixels.

5. The display device as defined in claim 3, further comprising:

a first scanning signal line drive circuit for driving the scanning signal lines corresponding to the first ones of the pixels; and a second scanning signal line drive circuit for driving the scanning signal lines corresponding to the second ones of the pixels.

6. The display device as defined in claim 3, further comprising:

a first scanning signal line drive circuit connected to a first group of the scanning signal lines; and a second scanning signal line drive circuit connected to a second different group of the scanning signal lines.

7. The display device as defined in claim 3, wherein the first data signal line driver comprises first and second driver portions having a switching circuit connected therebetween.

8. The display device as defined in claim 3, wherein one or the other of the first and second ones of the pixels comprise an L-shaped display portion.

9. The display device as defined in claim 3, further comprising:

a look-up table storing data indicative of the polarities for writing data to one of the first and second ones of the pixels.

10. A mobile telephone comprising a display device according to claim 3.

11. The display device as defined in claim 3, wherein the first and second refresh rates are set by prohibiting or permitting transfer of pulses involved in driving the scanning signal lines.

12. A display device comprising:

scanning signal lines;

data signal lines arranged to cross the scanning signal lines;

pixels arranged in the vicinities of the crossings of the scanning signal lines and the data signal lines;

first and second data signal line drivers, each data signal line being connected at one end thereof to the first data signal line driver and at the other end thereof to the second data signal line driver; and a control signal generating circuit for controlling the writing of data into the pixels so that data of a first type is written into first ones of the pixels through the data signal lines by the first data signal line driver at a first refresh rate and data of a second, different type is written into second, different ones of the pixels through the data signal lines by the second data signal line driver at a second, different refresh rate, wherein while one of the first and second signal line drivers is writing data, the other one of the first and second signal line drivers is stopped.

13. The display device as defined in claim 12, wherein the data of the first type comprises multiple gray scale data and the data of the second type comprises binary data.

14. The display device as defined in claim 12, wherein the first and second refresh rates are set by prohibiting or permitting transfer of pulses to the scanning signal lines.

* * * * *